US005297394A

United States Patent [19]

Frohbieter et al.

[11] Patent Number: 5,297,394

[45] Date of Patent: Mar. 29, 1994

[54] CLEAR CUBE ICE MAKER

[75] Inventors: Edwin H. Frohbieter, Lincoln Township, Berrien County; Andrew C. Reck, Hartford Township, Van Buren County; Roger D. Jewell, Lincoln Township, Berrien County; Donald E. Janke, Benton Township, Berrien County; Brian R. McClure, St. Joseph Township, Berrien County; Larry J. Manson, Baroda Township, Berrien County, all of Mich.

[73] Assignee: Whirlpool Corporation, Benton Harbor, Mich.

[21] Appl. No.: 12,240

[22] Filed: Feb. 2, 1993

Related U.S. Application Data

[63] Continuation-in-part of Ser. No. 815,970, Dec. 31, 1991, Pat. No. 5,187,948.

[51] Int. Cl.[5] ..... F25C 1/12

[52] U.S. Cl. ..... 62/135; 62/353

[58] Field of Search ..... 62/340, 351, 353, 405, 62/135

[56] References Cited

U.S. PATENT DOCUMENTS

| | | | |
|---|---|---|---|
| 2,990,804 | 8/1959 | Rising | 62/157 |
| 3,023,589 | 3/1962 | Jacobs | 62/156 |
| 3,146,606 | 9/1964 | Grimes et al. | 62/233 |
| 3,380,261 | 4/1968 | Hendrix et al. | 62/138 |
| 3,418,823 | 12/1968 | Vivai | 62/138 |
| 3,433,030 | 3/1969 | Jacobs | 62/186 |
| 3,482,413 | 12/1969 | Mann et al. | 62/68 |
| 3,526,100 | 9/1970 | Briel | 62/136 |
| 4,009,595 | 3/1977 | Barnard et al. | 62/300 |
| 4,045,979 | 9/1977 | Mazzini | 62/352 |
| 4,184,339 | 1/1980 | Wessa | 62/68 |
| 4,199,956 | 4/1980 | Lunde | 62/138 |
| 4,207,750 | 6/1980 | Simkens | 62/138 |

*Primary Examiner*—William E. Tapolcai

*Attorney, Agent, or Firm*—Wood, Phillips, VanSanten, Hoffman & Ertel

[57] ABSTRACT

An ice maker for use in a domestic refrigerator makes clear ice bodies. The ice maker comprises a support arranged to have an ice body formed thereon. The support is refrigerated to a below-freezing temperature and a container adapted to hold a body of water is moved to move liquid water contained therein uniformly about the support suitable to cause a clear substantially symmetrical ice body to build up outwardly on the refrigerated support.

43 Claims, 18 Drawing Sheets

CLEAR CUBE ICE MAKER

CROSS-REFERENCE

This application is a continuation-in-part of application Ser. No. 815,970 filed Dec. 31, 1991, now U.S. Pat. No. 5,187,948.

FIELD OF THE INVENTION

This invention relates to ice makers and, more particularly, to a clear cube ice maker for use in a refrigeration apparatus.

BACKGROUND OF THE INVENTION

Commercial ice makers have long been available for producing clear ice. A typical such ice maker is illustrated in Barnard U.S. Pat. No. 4,009,595 owned by the assignee hereof. Such an ice maker is intended for producing ample quantities of ice bodies and is not readily adaptable for use in a domestic refrigerator. Moreover, such an ice maker differs from those in domestic refrigerators in that it does not utilize a below-freezing compartment for maintaining the ice bodies in a frozen condition.

Ice makers for domestic refrigerators may produce ice bodies that are cloudy. This results from the ice bodies being formed in a tray wherein gases are trapped in solution in the freezing water. The commercial type ice makers discussed above produce clear ice because freezing proceeds from a cold surface into a water bath so that the freezing ice-water interfaces a surface from which gases coming out of solution can escape.

Apparatus have been disclosed for forming clear cube ice bodies in which a container holding a bath of water is moved in a cyclical manner to be proximate and remote from chilled fingers on which ice bodies are formed. Such an ice maker is not adapted to be placed in a freezer as the bath of water in the container would freeze, rendering the device inoperable. Moreover, such a device relies on mechanical, fixed structure which does not lend the device to be adaptable to varying refrigeration conditions.

Because the storage bin in a domestic refrigerator is contained in the freezer compartment, ice bodies are stored at below-freezing temperature. In order to prevent icing together of separate ice bodies it is necessary that the ice bodies must have dry surfaces when placed into the storage container.

The present invention is intended to overcome the problems discussed above.

SUMMARY OF THE INVENTION

In accordance with the invention there is disclosed a control for a clear cube ice maker.

Broadly, there is disclosed herein an ice maker for making clear ice bodies comprising a support arranged to have an ice body formed thereon and means for refrigerating the support to a below freezing temperature. A container is adapted to hold a body of water. Means are provided for moving the container to move liquid water contained therein uniformly about the support suitable to cause a clear, substantially symmetrical ice body to build up outwardly on the refrigerated support, comprising a tray supporting the container, the tray including support pins received in a track defining a path of movement of the tray, and a drive controlling movement of the tray. Means are provided for heating the container to prevent freezing of water container therein, and means for causing harvesting of the ice body from the support.

It is a feature of the invention that the pins comprise conductive pins and the heating means comprises an electrical heater connected to the pins.

It is another feature of the invention to provide electrical power terminals positioned at select locations of the tracks to control operation of the heating means incident to the tray being at a select position at the select location.

It is another feature of the invention that the heating means includes a control for operating the heating means only during a time when the moving means moves the container to move liquid water about the support.

It is another feature of the invention to provide storage means for causing repositioning of the container to withdraw the water in the container from adjacent the support prior to harvesting of the ice body.

It is yet another feature of the invention that the heating means includes a control for disabling the heating means during a time period when the storage means repositions the container to withdraw water from adjacent the support.

In accordance with another aspect of the invention there is disclosed an ice maker comprising a support arranged to have an ice body formed thereon, comprising a hollow plastic tubular member open at a near end and closed at a distal end. Refrigeration means conduct refrigerated fluid through the open end of the tubular member to refrigerate the support to a below freezing temperature. Means are provided for moving a container holding a body of water to move liquid water contained therein uniformly about the support suitable to cause a clear substantially symmetrical ice body to build up outwardly on the refrigerated support adjacent the closed end of the tubular member. Means cause harvesting of the ice body from the tubular member comprising means conducting heated fluid through the open end of the tubular member to heat the support to an above freezing temperature. Means sense temperature of the fluid. The means for causing harvesting of the ice body further comprises means for terminating conduction of heated fluid through the open end of the tubular member responsive to temperature sensed by the sensing means being above a select temperature value.

There is disclosed in accordance with another aspect of the invention cycle means for moving the container to move liquid water contained therein uniformly about the support suitable to cause a clear, substantially symmetrical ice body to build up outwardly on the refrigerated support. Storage means cause repositioning of the container to withdraw the water in the container from adjacent the support. Control means control operation of the cycle means and the storage means and are operable to operate the cycle means for a select time duration prior to operation of the storage means during a batch operation of the ice maker.

It is a feature of the invention that the control means includes means for sensing temperature of the ice maker and adaptive control means for varying the select time duration responsive to sensed temperature to provide uniform sized ice bodies in different batch operations of the ice maker.

There is disclosed in accordance with a further aspect of the invention an ice maker including a support arranged to have an ice body formed thereon and means refrigerating the support to a below freezing temperature. A container is adapted to hold a body of water. A motor controlled drive includes an electric motor operatively coupled to the container for moving the container. A control circuit controls energization of the motor including means for determining duration of motor energization, first drive means for energizing the motor for a first select duration to raise the container, second drive means for energizing the motor for a second select duration to lower the container, and switching means for alternately operating the first and second drive means in successive dip cycles to reciprocally move the container to move liquid water contained therein uniformly about the support suitable to cause a clear, substantially symmetrical ice body to build up outwardly on the refrigerated support.

It is a feature of the invention that the motor comprises a synchronous motor and the determining means determines a number of power cycles for which the motor has been energized.

It is a feature of the invention that the first select duration is equivalent to the second select duration.

It is another feature of the invention that the determining means comprises a counter means for storing a value representing the duration.

It is an additional feature of the invention to provide means for counting number of dip cycles and reference means for operating one of the first and second drive means after a select number of dip cycles to move the container to a reference position and to thereafter reset the counter to a reference value.

It is another feature of the invention to provide storage means for causing repositioning of the container to withdraw the water in the container from adjacent the support and the control circuit controls operation of the switching means and the storage means is operable to operate the switching means for a select time duration prior to operation of the storage means during a batch operation of the ice maker.

It is a feature of the invention that the control circuit includes means for sensing temperature of the ice maker and adaptive control means for varying the select time duration responsive to sensed temperature to provide uniform sized ice bodies in different batch operations of the ice maker.

It is another feature of the invention to provide means for causing harvesting of the ice body from the support comprising means for heating the support to an above freezing temperature.

There is disclosed in accordance with yet another aspect of the invention an ice maker comprising a support arranged to have an ice body formed thereon and means for refrigerating the support to a below freezing temperature. A container is adapted to hold a body of water. Means are provided for moving the container to move liquid water contained therein uniformly about the support suitable to cause a clear, substantially symmetrical ice body to build up outwardly on the refrigerated support. Storage means cause repositioning of the container to withdraw the water in the container from adjacent the support. Means are provided for providing harvesting of the ice body from the support. The means for moving liquid water about the support includes means for utilizing a select volume of water in the container to form the ice body, the select volume being determined by level of water in the container and temperature of the support, and means for adding a fixed volume of water to the container subsequent to harvesting of the ice body from the support to provide a uniform, average volume ice body over a plurality of ice body making cycles.

It is a feature of the invention to provide a control means for controlling operation of the moving means for a select time duration prior to operation of the storage means during a batch operation of the ice maker.

It is another feature of the invention that the control means includes means for sensing temperature of the ice maker and adaptive control means for varying the select time duration responsive to sensed temperature to provide uniform sized ice bodies in different batch operations of the ice maker.

It is a feature of the invention that the adaptive control means varies the select time generally proportional to sensed temperature.

It is an additional feature of the invention that the sensing means comprises a first charging circuit including a temperature sensitive resistance, a second charging circuit including a reference resistance and a control circuit for alternately operating the first and second charging circuits and comparing length of time required for each charging circuit to reach a select charge level, a difference in such times representing ice maker temperature.

Further features and advantages of the invention will be readily apparent from the specification and from the drawings.

DESCRIPTION OF THE INVENTION

Figure 1:
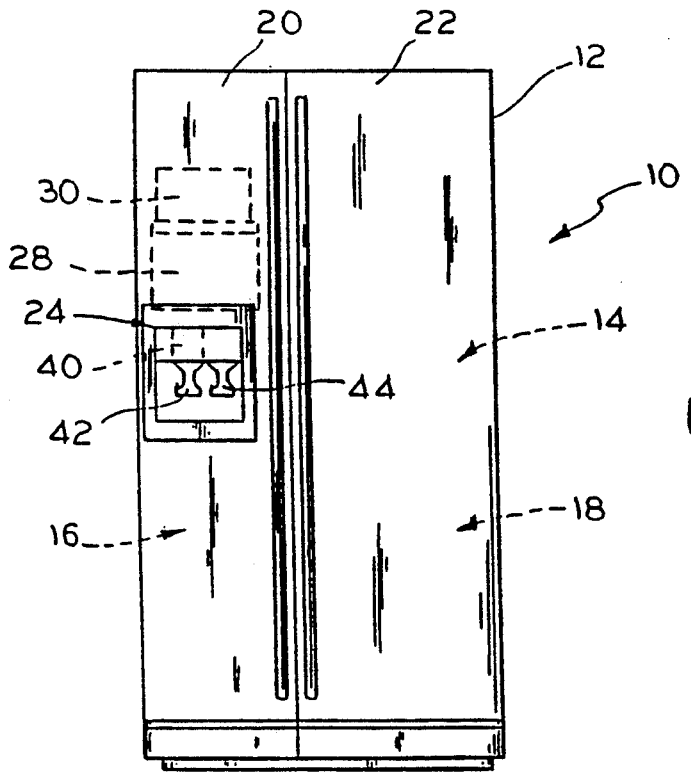
FIG. 1 is a front elevation view showing a refrigeration apparatus including an ice maker according to the invention.

With reference to FIG. a refrigeration apparatus 10, comprising a side-by-side refrigerator/freezer, includes a cabinet 12 housing a storage space 14. Particularly, the storage space 14 comprises a below-freezing, or freezer, compartment 16, and an above-freezing, or fresh food, refrigerator compartment 18. Access to the compartments 16 and 18 is had through respective freezer and refrigerator doors 20 and 22, respectively, hingedly mounted to the cabinets 12, as is well known.

The freezer door 20 is provided with a through-the-door ice dispensing apparatus 24. The dispensing apparatus 24 is partially contained within a housing 26, see FIG. 2, suitably mounted in the freezer door 20.

Figure 2:
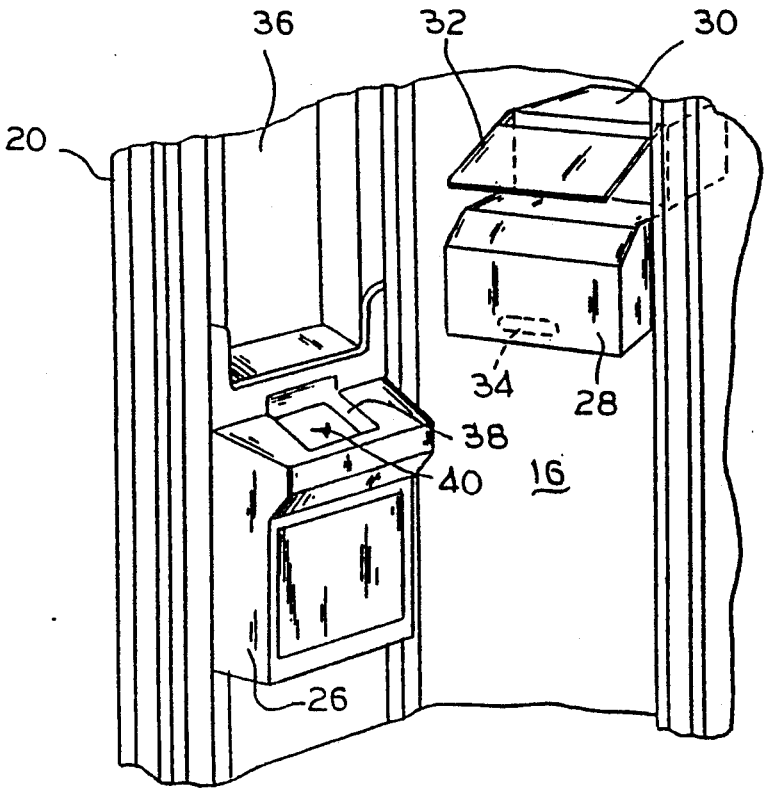
FIG. 2 is a partial perspective view of the refrigeration apparatus of FIG. 1 with a freezer door in an open position.

With reference also to FIG. 2, an ice container assembly 28 in the freezer compartment 16 stores ice bodies which are delivered thereto from a superjacent ice maker 30 according to the invention. A door 32 is hingedly mounted in the freezer compartment 16 to provide selective access to the ice maker 30. The ice container assembly 28 includes a conveyor structure of any known form for conveying ice cubes to a downwardly facing discharge opening 34.

The freezer door 20 includes an interior panel 36 including an opening 38 in communication with an ice chute 40. When the door 20 is in the closed position, the opening 38 is positioned immediately below the container assembly discharge opening 34. Ice bodies may be obtained by placing a suitable container against an actuator 42, see FIG. 1, which opens a closure (not shown) and actuates the ice container assembly 28 to deliver ice bodies to the chute 40 for dispensing. Suitable switching devices are provided for actuating the conveyor structure, as is well known. An additional lever 44 is provided for dispensing chilled water. The structure for doing the same is not specifically disclosed herein as it does not relate to the invention.

Figure 3:
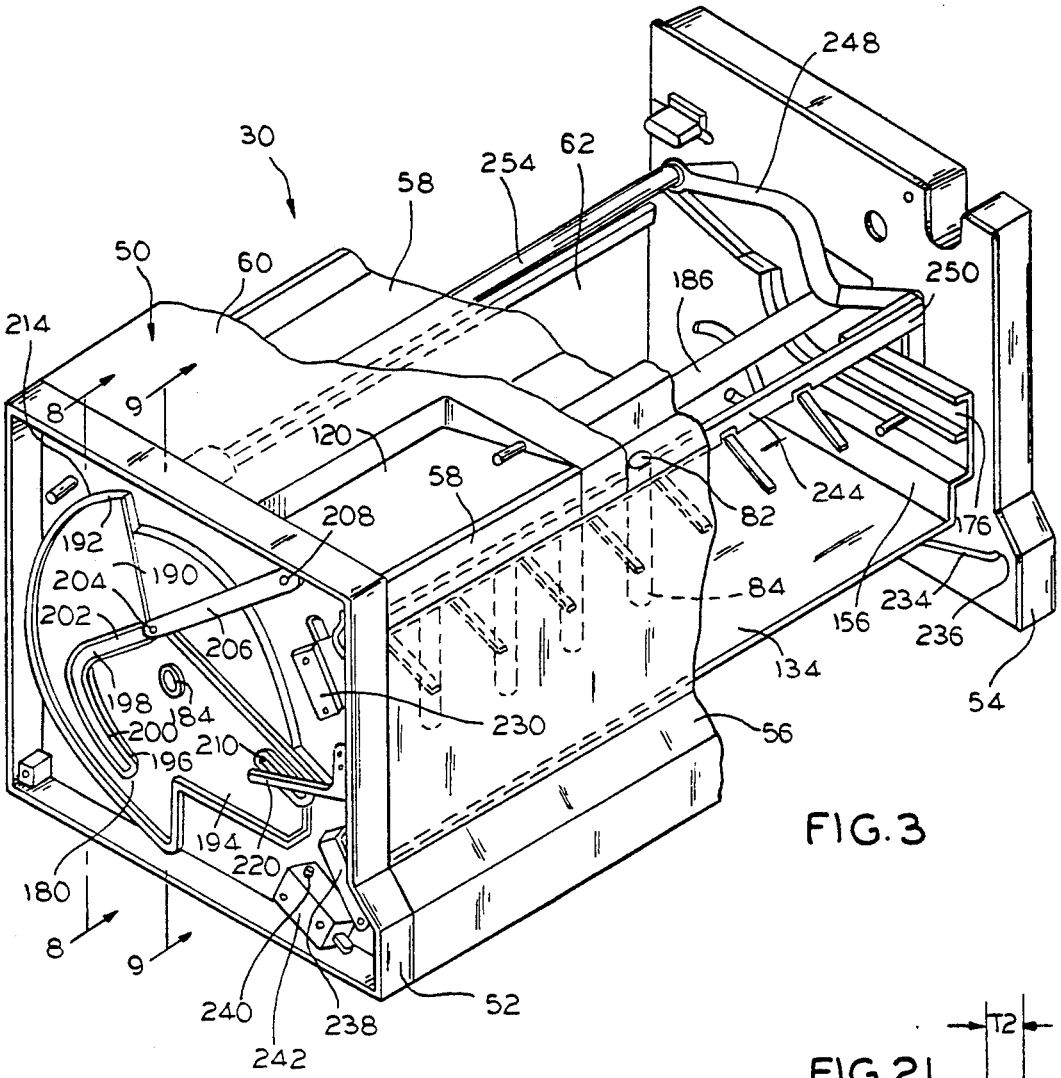
FIG. 3 is a partial perspective view, with parts removed for clarity and shown in cutaway of the ice maker according to the invention.
Figures 4, 5:
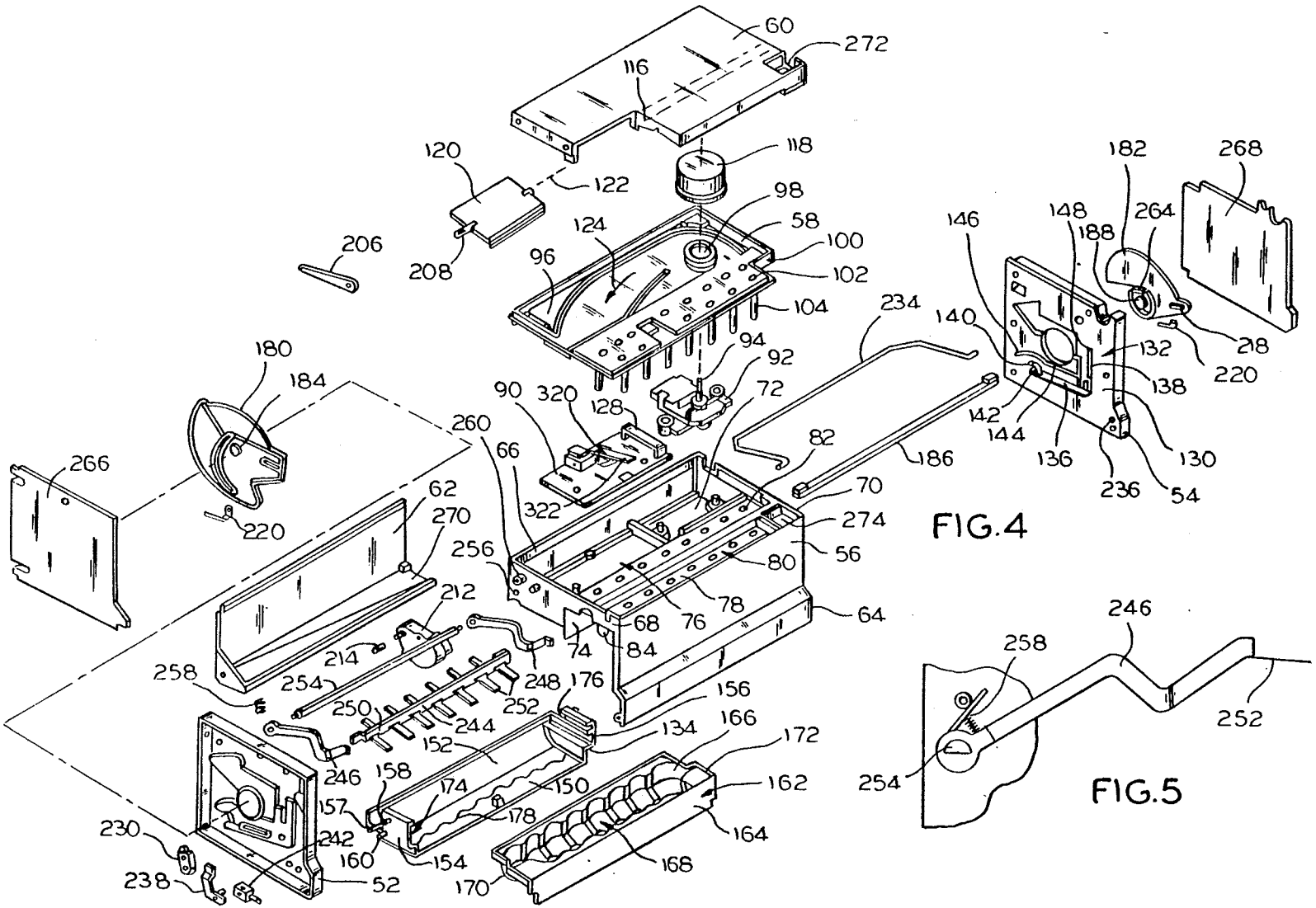
FIG. 4 is an exploded view of the ice maker of FIG. 3.
FIG. 5 is a detail side elevation view illustrating a spring bias of the stripper arm.
Figures 4, 5:
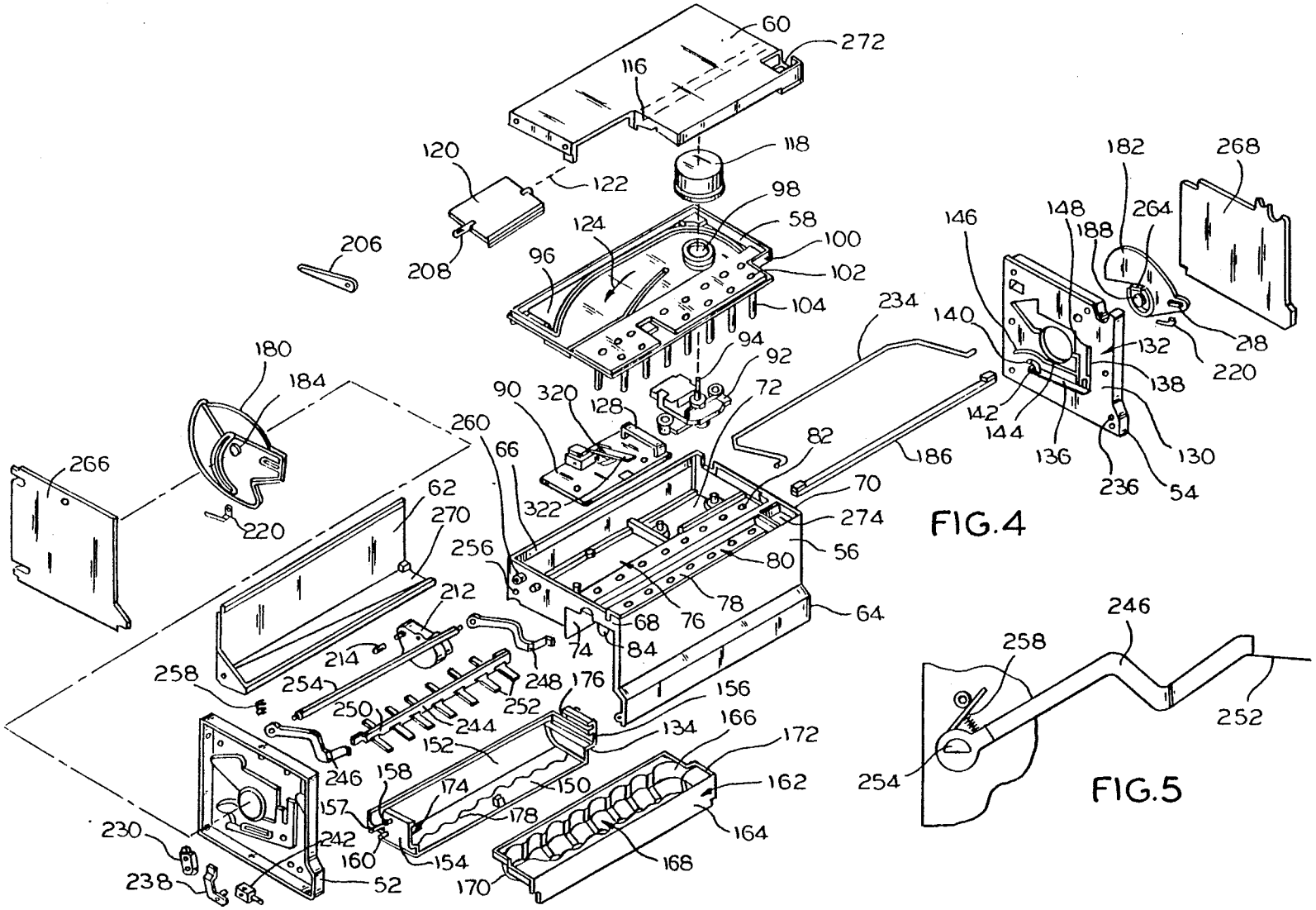

With reference to FIGS. 3 and 4, the ice maker 30 is illustrated in greater detail. The ice maker 30 provides clear ice by freezing water in a manner such that gases in solution can escape. To provide a smooth ice body with a crystal clear appearance, the ice maker 30 provides a relative motion between the freezing ice and the bulk water volume it is freezing from. This motion polishes the ice surface while it is freezing and mixes the bulk water volume it is freezing from to maintain uniform temperature in the freezing bath. Further, the ice bodies have dry, frozen surfaces when placed into the container assembly 28 to prevent the ice bodies from freezing into a large unusable mass. Finally, the ice maker 30 prevents the water volume from freezing and periodically dumps the same to maintain a usable low solids and salt content freezing bath and to prevent freeze up when it is not making ice.

The ice maker 30 comprises a housing 50 including front and rear wall housings 52 and 54, respectively, sandwiching a lower plenum housing 56. An upper plenum housing 58 is received atop the lower plenum housing 56 and is covered by a top cover wall 60. An outside wall 62 also extends between the front and rear wall housings 52 and 54, respectively, below the lower plenum housing 56.

For simplicity herein, the end of the ice maker defined by the front wall housing 52 is referred to as the front portion as it is positioned front most in the freezer space 16 in use, while the rear wall housing 54 is positioned near a rear wall in the freezer space 16. Similarly, the outside wall 62 is positioned adjacent an outside wall of the freezer space 16, i.e. to the left in FIGS. 1 and 2, while an opposite portion is referred to herein as inside.

Figure 16:
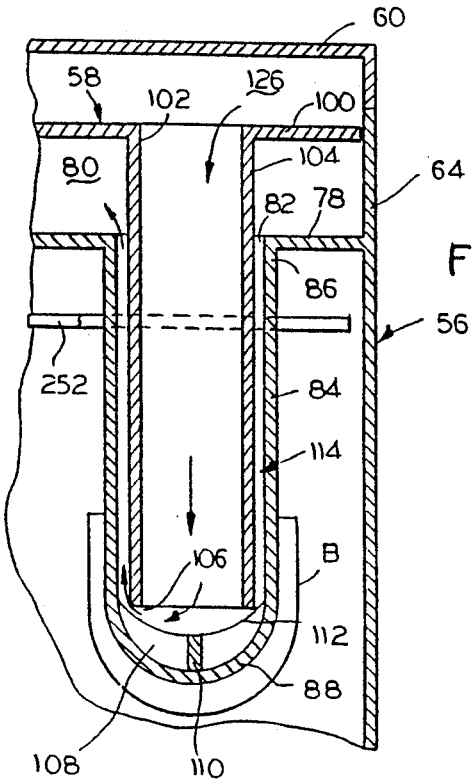
FIG. 16 illustrates air flow paths during a dipping cycle for the formation of an ice body.
Figure 18:
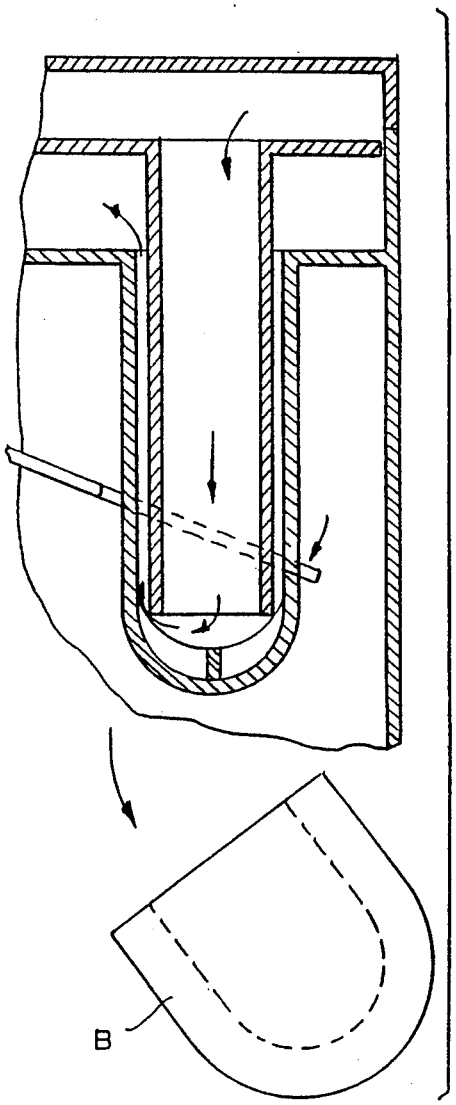
FIG. 18 is a view similar to that of FIG. 17 at the completion of the harvest cycle.

The lower plenum housing 56 is of integral plastic construction. The housing 56 includes an inside wall 64 and outside wall portion 66 connected by front and rear walls 68 and 70. A lower wall 72 is connected between the front and rear walls 68 and 70, to the outside wall 66 and to an intermediate wall 74 to define an outer, upwardly opening space 76. A somewhat elevated inside lower wall portion 78 is connected between the intermediate wall 74 and the inside wall 64 and also between the front and rear walls 68 and 70, respectively, and defines an inner, upwardly opening space 80. The lower wall portion 78 includes a plurality of through openings 82 connected to downwardly depending fingers 84. Particularly, in the illustrated embodiment, there are fifteen openings 82 and connected fingers 84. The fingers 84 comprise supports arranged to have an ice body formed thereon. With reference to FIG. 16, each finger 84 comprises a hollow tubular member open at a top end 86 to the opening 82 and closed at a lower, distal and rounded end 88. The lower end 88 is shaped to provide the configuration for the inside of an ice body B to be formed thereon, as illustrated.

The lower plenum housing outer space 76 houses an electrical control board 90 and blower motor 92 rearwardly thereof. The blower motor 92 has an upwardly extending vertical shaft 94.

The upper plenum housing 58 comprises a generally rectangular horizontal wall 96. The wall 96 is of a size and configuration to fit atop the lower plenum housing 56 and between the front and rear walls 68 and 70, respectively, and the inside and outside walls 64 and 66, respectively. The horizontal wall 96 includes an enlarged circular opening 98 having its center corresponding to and for receiving the motor shaft 94. An innermost section 100 of the wall 96 includes a plurality of openings 102. A plurality of hollow, downwardly depending tubes 104 extend from the inner wall portion 100, one at each opening 102, see FIG. 16. Each tube 104 is received in one of the fingers 84 incident to placement of the upper plenum housing 58 on the lower plenum housing 56, as discussed above. Each tube 104 is opened at a lower end 106.

To facilitate alignment of the tubes 104 and the fingers 84, each finger includes a pair of vertical, crisscrossed crescent-shaped walls 108 and 110. An upper arc surface 112 on the walls 108 and 110 centers the tube 104 in the finger 84 to maintain a uniform space 114 therebetween around the entire periphery of the tube 104.

The cover 60 is of a size corresponding to the upper and lower plenum housings 58 and 56, respectively, except for a rectangular cutout 116. Prior to installing the cover atop the lower plenum housing 56, a blower wheel 118 is mounted to the motor shaft 94 above the upper plenum housing wall 96.

A damper 120 is mounted between the cover 60 and the front wall 52 at the opening 116. The damper 120 is pivotal about an axis represented by the line 122 for controlling air flow.

The blower wheel 118 is configured so that suction is present at the upper plenum housing opening 98 and its discharge is as indicated by an arrow 124, see FIG. 4, toward the cover opening 116. With suction at the opening 98, air is drawn from a space 126 between the cover 60 and upper plenum housing wall 100, see FIG. 16, and downwardly through the tube 104. Air exits the tube 104 around its lower end 106 and into the space 114 between the tube 104 and the finger 84 and exits into the space 80 where it returns to the suction side of the blower wheel 118.

Figure 9:
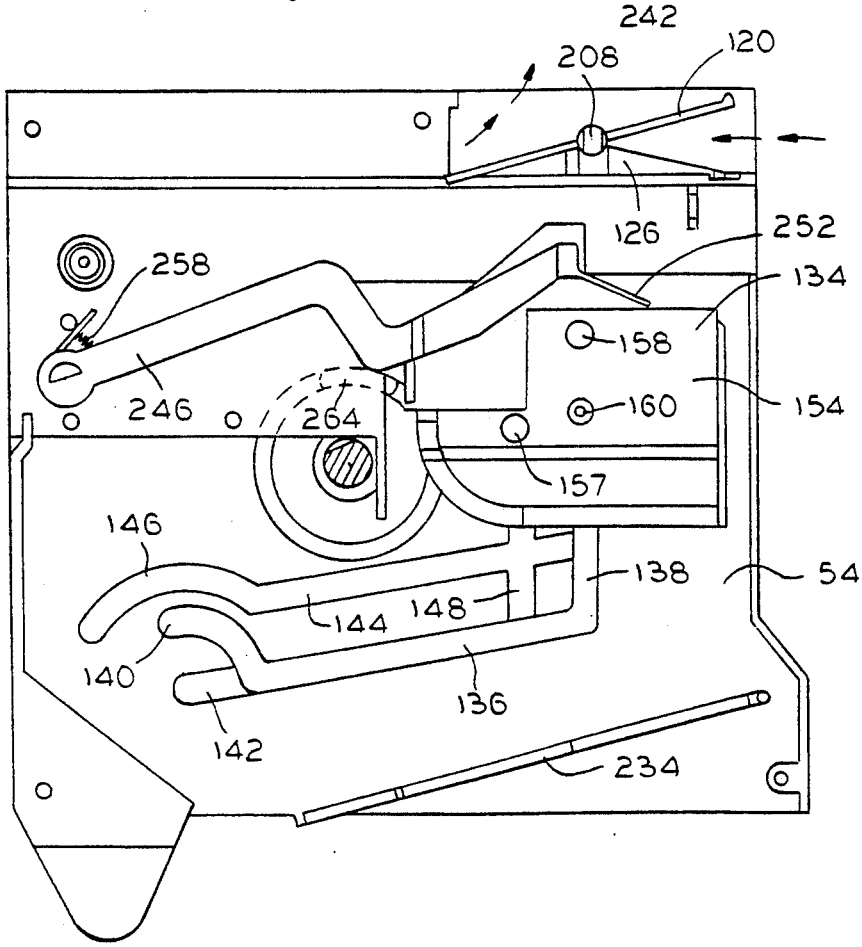
FIG. 9 is a side elevation view taken along the line 9—9 of FIG. 3 with an ice tray support in the top dip position.
Figure 13:
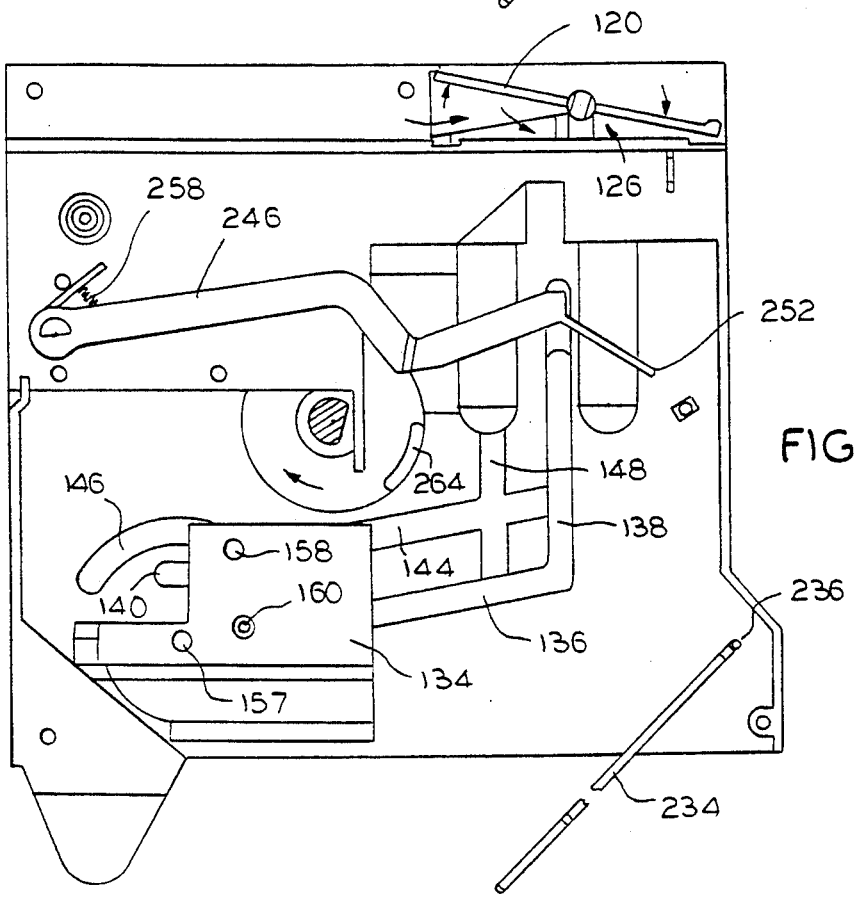
FIG. 13 is a view similar to that of FIG. 9 with the tray support in the harvest and park position.
Figure 14:
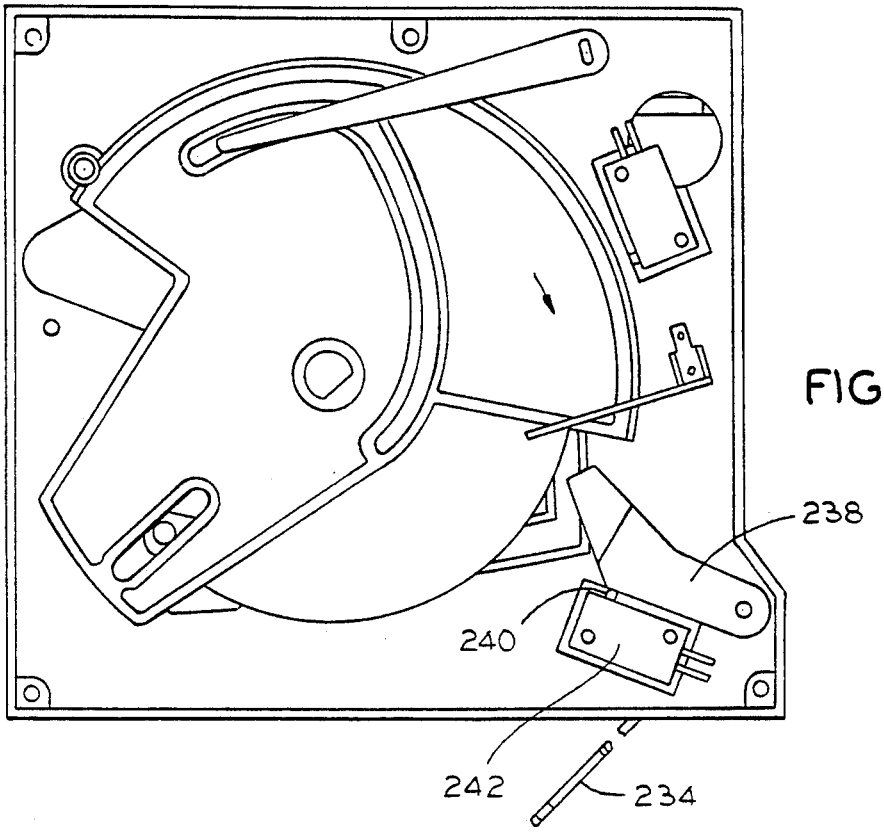
FIG. 14 is a view similar to that of FIG. 8 with the tray support in a dump position.

The source of air flow depends on the position of the damper 120. Particularly, when the damper 120 is in an open position, as illustrated in FIG. 9, air at a below-freezing temperature is drawn into the space 126, as illustrated, so that below-freezing fluid, in the form of refrigerated air, passes through the fingers 84 to refrigerate the same. Exhaust air exits above the damper 120, as illustrated. When the damper 120 is in a closed position, as illustrated in FIG. 13, exhaust from the blower wheel 100 is recirculated into the space 126 so that below-freezing air is not used. In fact, a heater element 128 on the control board 90 is energized during specified operational cycle times when the damper 120 is closed so that the circulating air is heated, as discussed below.

The rear wall housing 54 includes a rear wall 130 formed with a series of front facing tracks 132 for controlling movement of a tray carrier 134. The tracks 132 include a generally horizontal elongate lower through opening 136 connected at an inner end to a vertical through opening 138 and an outer end to an arcuate upwardly extending through opening 140. The lower horizontal opening 136 also continues at its rear end to a counter bored groove 142 below the arcuate opening 140, see FIG. 9. An upper horizontal elongate groove 144 is provided in parallel to the lower opening 136 and is connected to the front vertical opening 138 at its inner end and to an arcuate portion 146 at its outer end. An outer vertical groove 148 is parallel to and spaced outwardly from the inner vertical opening 138. The vertical groove 148 connects at a lower end to the lower horizontal opening 136 and crosses the horizontal groove 144.

Although not specifically described herein, the front wall housing 52 includes a front wall having similar tracks formed therein, albeit a mirror image, facing the tracks 132 on the rear wall 54 to guide movement of the carrier 134.

The carrier 134 includes a bottom wall 150 connected to a vertical outer wall 152 and front and rear walls 154 and 156, respectively. Extending frontwardly from the front wall 154 are three pins 157, 158 and 160 in a triangular configuration. The lower, innermost pin 160 is longer than the pins 157 and 158, with the pin 158 being directly above the pin 160 and the pin 157 being outwardly thereof to define an obtuse angle vertex of the triangular configuration. Although not specifically discussed, the rear wall 156 includes a similar array of pins extending rearwardly therefrom.

The carrier 134 is received between the front wall housing 52 and the rear wall housing 54, as shown in FIG. 3. Particularly, the pins are received in the tracks 132 for guiding movement. This relationship can be best understood with reference initially to FIG. 9 when viewing the position of the pins 157, 158 and 160 relative to the tracks 132 of the rear housing wall 54.

Figure 15:
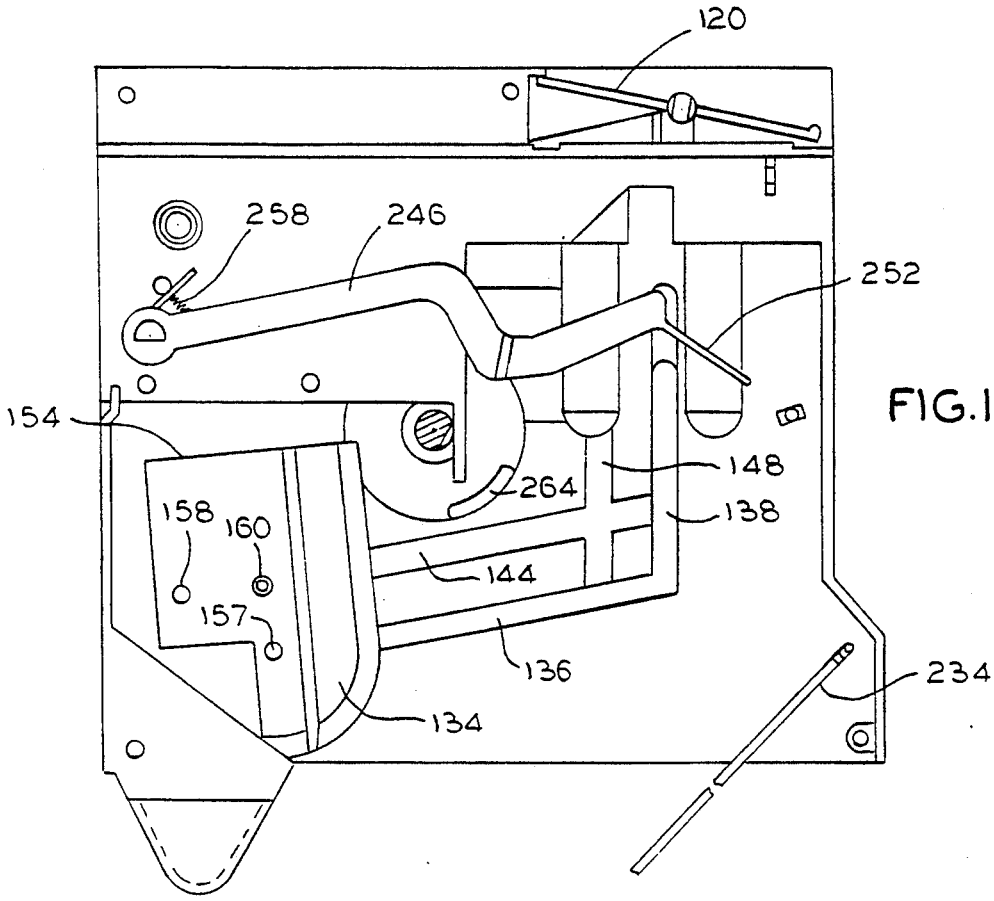
FIG. 15 is a view similar to that of FIG. 9 with the tray support in the dump position.

The pin 160, being longer than the pins 157 and 158 extends through either the approximately horizontal opening 136 or the vertical opening 138. Indeed, the pin 160 is driven by a structure described below to control movement of the carrier 134. The pins 157 and 158 are received in the tracks to maintain the carrier 134 in a desired orientation. During vertical movement of the carrier 134, the pins 157 and 158 are received in the respective vertical groove 148 and vertical through opening 138, as illustrated in FIG. 9. During horizontal movement of the carrier 134, the upper pin 158 is received in the upper groove 144 while the lower pin 157 is received in the lower approximately horizontal through opening 136, as illustrated in FIG. 13. During a dump cycle, the upper pin 158 is received in the upper arcuate groove 146, while the lower pin 157 is received in the lower substantially horizontal groove 142 to tip the carrier 134, as illustrated in FIG. 15.

A water tray 162 is carried on the support 150 and includes an inner wall 164 connected to a formed housing 166 defining an upwardly opening space 168 to be filled with a volume of water. The space 168 is large enough to accommodate the fifteen fingers 84 and provide ample space around each finger 84 for the formation of an ice body, as described below. Front and rear ridges 170 and 172, respectively, are receivable in facing tracks 174 and 176 in the carrier front and rear walls 154 and 156, see FIG. 4.

In order to prevent freezing of water stored in the space 168, a resistance heater wire 178 is supported on the carrier bottom wall 150 between the tray carrier 134 and the tray 162. The resistance heater wire 178 is connected to the pin 160 at each end which comprises a conductive pin for connection to an electrical circuit as discussed below.

To control movement of the carrier 134, front and rear cams 180 and 182 are used. The front cam 180 is positioned in the front wall housing 52 and the rear cam 182 is positioned in the rear wall housing 54, as illustrated.

With reference to FIG. 3, the front cam 180 is generally circular in configuration and includes a central opening 184 for receiving a shaft 186 connecting the front cam 180 to the rear cam 182 at an opening 188, see FIG. 4. The front cam 180 includes a generally semi-circular section 190 having an outer circumferential, toothed surface 192. An elongate arm portion 194 extends from the semi-circular portion 190 in a quadrant clockwise from the circular portion as viewed in FIG. 3. A continuous ridge 196 extending frontwardly from the cam 180 defines an elongate groove 198 including a circumferential portion 200 generally parallel to the outer toothed wall 192 and connected to a curved radially inwardly directed portion 202. The groove 198 receives a pin 204 on an arm 206 which connects to a pin 208 on the damper 120 for controlling positioning of the same.

Figure 8:
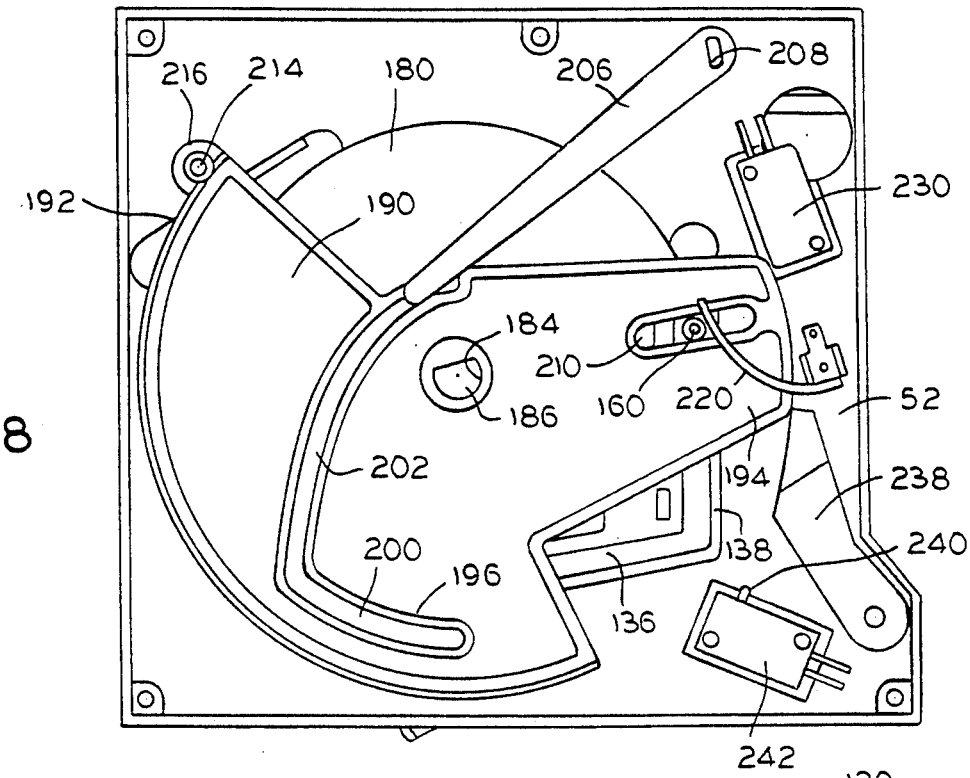
FIG. 8 is a front elevation view taken along the line 8—8 of FIG. 3 with an ice tray support in a top dip position.

The cam arm portion 194 includes a radially extending through slot 210 spaced from the central opening 184. The through slot 210 receives the longer, conductive pin 160 from the carrier 134, as illustrated in FIG. 8.

The front cam 180 is driven by a synchronous motor 212 driving a gear 214 extending through an opening 216 in the front wall housing 52. Particularly, the gear 214 engages the toothed outer surface 192 to rotate the cam 180 about an axis of the shaft 186. Rotational movement of the front cam 180 is converted to linear movement of the pin 160 guided in the openings 138 and 136. Rotation of the shaft 186 also drives the rear cam 182. The rear cam 182 is generally semi-circular in shape and also includes an elongate radial slot 218 for receiving a conductive pin 160 from the rear wall 156 of the carrier 134. Thus, the motor 212 is operable to drive the carrier 134 at both ends using the cams 180 and 182 to provide controlled, uniform movement of the carrier 134 and the tray 162.

To operate the heater 178, a pair of terminals in the form of spring switch blades 220 are used, one associated with the front cam 180 and the other the rear cam 182. As illustrated in FIG. 3, one blade 220 is mounted to the front wall housing 52 so that it extends across the inner vertical slot 138 about a central portion thereof. As particularly illustrated in FIG. 8, the conductive pin 160 extends through the vertical slot 138 and the cam slot 210. When the pin 160 is in the vertical opening 138 about its midpoint, it is engaged by the blade 220. Although not specifically illustrated, a similar connection is provided at the rear wall housing 54. Thus, when power is applied to the spring blades 220 and the carrier 134 is in the suitable position, the heater wire 178, see FIG. 4, is energized.

In order to sense a reference or zero position of the cam 180, a zero reference switch 230 is mounted in the front wall housing 52 in an upper right-hand corner as viewed in FIG. 3. The switch 230 includes an actuator 232, see FIG. 10, actuated by the cam arm 194 when the carrier 134 is in a top dip position, see FIG. 8.

When the container assembly 28, see FIGS. 1 and 2, is full of ice bodies, it is desirable to prevent further operation of the ice maker 30. In accordance therewith, a bin arm 234 is provided for sensing the level of ice bodies. The bin arm 234 is pivotally mounted to the rear wall housing 54 as at an opening 236 and through a similar opening in the front wall housing 52 where it is mounted to a lever 238. The lever 238 is supported in an "up" position when the carrier 134 is controlled for vertical movement, as by the arm portion 194 being at approximately a "four o'clock" position, see FIGS. 8 and 10. The lever is released when the carrier 134 is controlled for horizontal movement , as by the arm portion 194 being at approximately a "seven o'clock" position, see FIG. 12. When the lever 238 is released, it actuates an actuator 240 of a bin arm switch 242.

In order to facilitate harvesting of ice bodies from the fingers 84, a stripper 244, see FIG. 4, is used. The stripper 244 includes front and rear arms 246 and 248, respectively, connecting a cross bar 250. Extending transversely from the cross bar 250 are a plurality of oppositely directed, flexible stripper blades 252. Outer ends of the arms 246 and 248 are connected to a torque bar 254 for pivotal movement. Each stripper blade is positioned alongside one finger 84. The torque bar 254 extends through an opening 256 in the lower plenum front wall 68 when it is connected to the front arm 246, see FIG. 5. A spring 258 engaging a tab 260 biases the arm 246 downwardly. The rear cam 182 includes a frontwardly directed cam actuator 264 for bearing on the stripper arm 248 to force the same upwardly when the cams are rotated for providing vertical reciprocal movement of the tray carrier 134. Although not shown, the front cam 180 includes a similar cam actuator.

When assembled, the front and rear wall housings 52 and 54 are fastened to the lower housing plenum 56 using suitable fasteners (not shown). Front and rear cover plates 266 and 268, see FIG. 4, are subsequently fastened to their respective housings 52 and 54 to cover the same.

The outer wall 62 includes a lower, rearwardly and downwardly directed trough 270 for dumping water when necessary. When installed in a freezer compartment, a rear portion of the trough 270 is positioned adjacent suitable apparatus for disposing of such water.

In order to fill the tray 162 with water an opening 272 is provided through the cover 60 at a rear inner corner thereof communicating with similar opening 274 in the lower plenum housing 56 positioned above the tray 162. Although not shown, a hose would be positioned in such opening and connected via a solenoid valve 342, see FIG. 6B, to a source of water for filling the tray 162 as necessary.

Figure 6A:
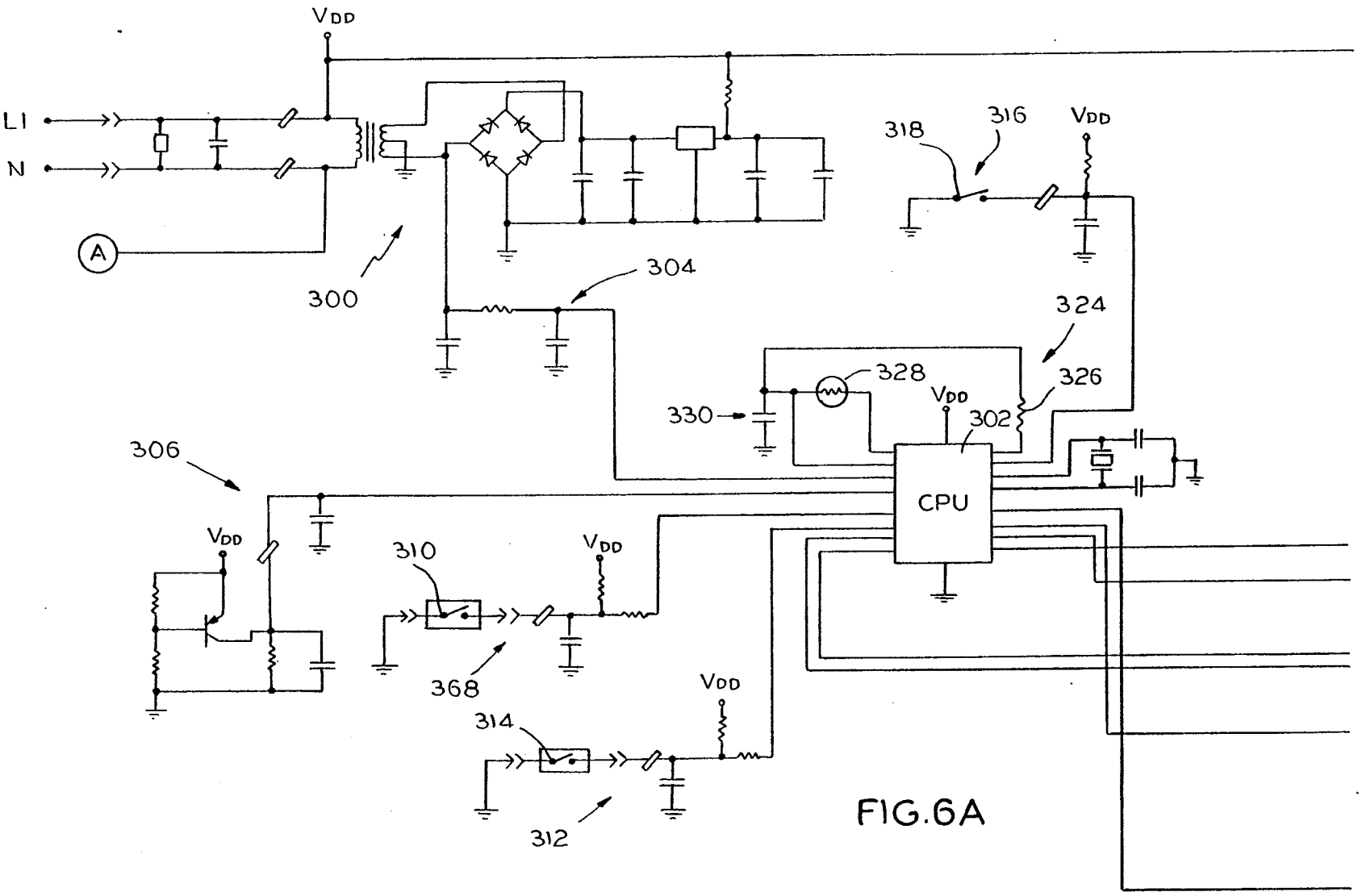
FIGS. 6A and 6B comprise an electrical schematic illustrating a control circuit for the ice maker.
Figure 6B:
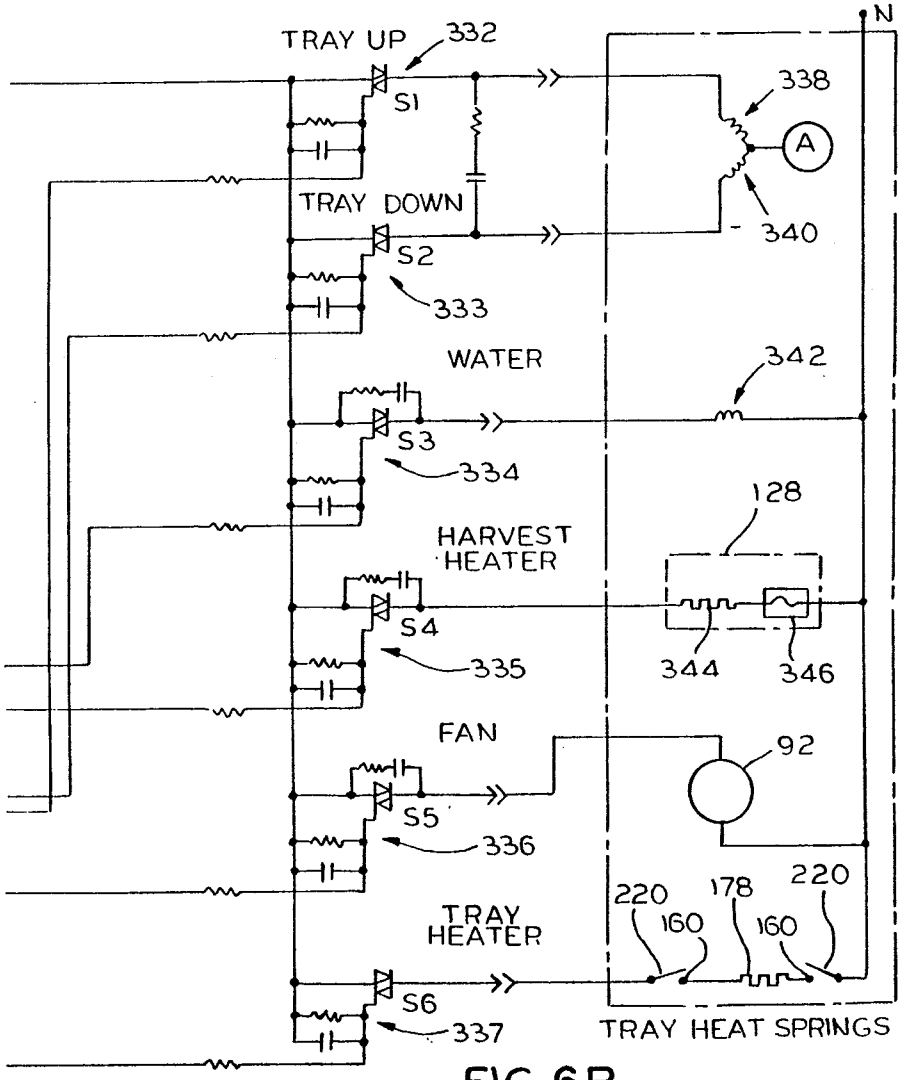

With reference to FIGS. 6A and 6B, a schematic diagram illustrates a control circuit for the ice maker 30.

AC power is provided across terminals labelled L1 and N to a power supply circuit 300. The power supply circuit 300 is a conventional such circuit for converting AC power to DC power at suitable level for operating the various components described below, including a CPU 302. The CPU comprises a conventional microcontroller including onboard microprocessor and associated RAM and ROM memory circuits, as is well known. Particularly, the CPU 302 is connected to plural input and output devices and is operated by a control program, as described below, for controlling output devices based on status of input devices.

A zero cross detecting circuit 304 is connected to the power supply circuit 300 and an input port of the CPU 302. The zero cross detector circuit 304 provides a discrete input to the CPU 302 at each zero crossing of the AC supply for counting cycles of input power. More particularly, the line cycle count is used for determining position of the tray 162, see FIG. 4, based on the number of cycles in which power is supplied to the motor 212, comprising a synchronous motor. As is known, with a synchronous motor the number of motor shaft turns is directly related to the number of power cycles applied to the motor windings.

A power on reset circuit 306 is connected to an additional input of the CPU 302. The power on reset circuit 306 provides a pulse when power is first supplied for resetting the CPU 302 to a select, initial operating mode.

A zero switch circuit 308 is connected to an additional input of the CPU 302. The zero switch circuit 308 includes a contact switch 310 associated with the zero reference switch 230, see FIG. 3. This contact is used for indicating a reference position of the tray 162, see FIG. 4.

A bin switch circuit 312 is connected to an additional input port of the CPU 302. The bin switch circuit 312 includes a contact 314 associated with the bin arm switch 242, see FIG. 3. The bin switch circuit 312 provides an input to the CPU indicating the position of the bin arm 234.

A stripper switch circuit 316 is connected to a further input of the CPU 302. The stripper switch circuit 316 includes a contact 318 associated with a stripper switch 320 on the electrical control board 90, see FIG. 4. The stripper arm switch 320 includes an actuator 322 sensing position of the stripper cross bar 250. Particularly, when the stripper cross bar 250 is in a raised position as caused by the cam 264, see FIG. 9, or ice bodies are present on the fingers 84, the contact 318 is in a normally open position. When the cam 64 permits the stripper to drop under bias of the spring 258 and there are no ice bodies present on the fingers 84, then the stripper arm switch 320 is actuated to close the contact 318.

A temperature sensing circuit 324 is used for determining freezer compartment temperature. Particularly, the temperature sensing circuit 324 senses temperature of air flow through the ice maker 30, represented by the arrow 124 of FIG. 4.

The temperature sensing circuit 324 includes dual outputs from the CPU 302 connected to a parallel calibration resistor 326 and a thermistor 328. The junction between the resistor 326 and thermistor 328 is also connected to a capacitor 330 and to an input of the CPU 302. The resistor 326, thermistor 328 and capacitor 330 are all mounted on the control board 90, see FIG. 4.

The CPU 302 includes six additional output ports connected one each for driving a tray up drive circuit 332, a tray down drive circuit 333, a water valve drive circuit 334, a harvest heater drive circuit 335, a fan drive circuit 336 and a tray heater drive circuit 337, see FIG. 6B. Each of the drive circuits 332–337 includes a respective triac labelled S1–S6 gated by the associated output from the CPU 302 and connected to the L1 side of the power source.

The drive motor 212, see FIG. 4, includes separate forward and reverse windings 338 and 340. One side of the winding 338 is connected to the triac S1 of the tray up drive circuit 332. One side of the winding 340 is connected to the triac S2 of the tray down drive circuit 333. An opposite side of each winding 338 and 340 is connected to the neutral terminal. Particularly, when the winding 338 is energized, the motor 212 is driven to drive the cam 180 counterclockwise to raise the carrier 134 and thus the tray 162. Conversely, when the winding 340 is energized, the motor 212 is operated to drive the cam 180 clockwise to lower the carrier 134 and thus the tray 162.

The water valve drive circuit 334 includes a solenoid valve 342 connected between the associated triac S3 and the neutral terminal. The water valve 342 is used for filling the tray 162 with a select volume of water.

The harvest heater drive circuit 335 includes the harvest heater 128, see FIG. 4, comprising a heating element 344 and a thermal fuse 346 connected between the neutral terminal and the associated triac S4.

The fan drive circuit 336 includes the blower motor 92 connected between the neutral terminal and the triac S5 of the fan drive circuit 336.

The tray heater circuit 337 includes the tray heater 178 connected between the conductive pins 160 and blade wipers 220 between the neutral terminal and the triac S6 of the tray heater drive circuit 337.

With reference to FIGS. 7A–7F, a flow diagram illustrates a control program implemented by the CPU 302, see FIG. 6A, for controlling operation of the ice maker 30, see FIG. 2.

Figure 7A:
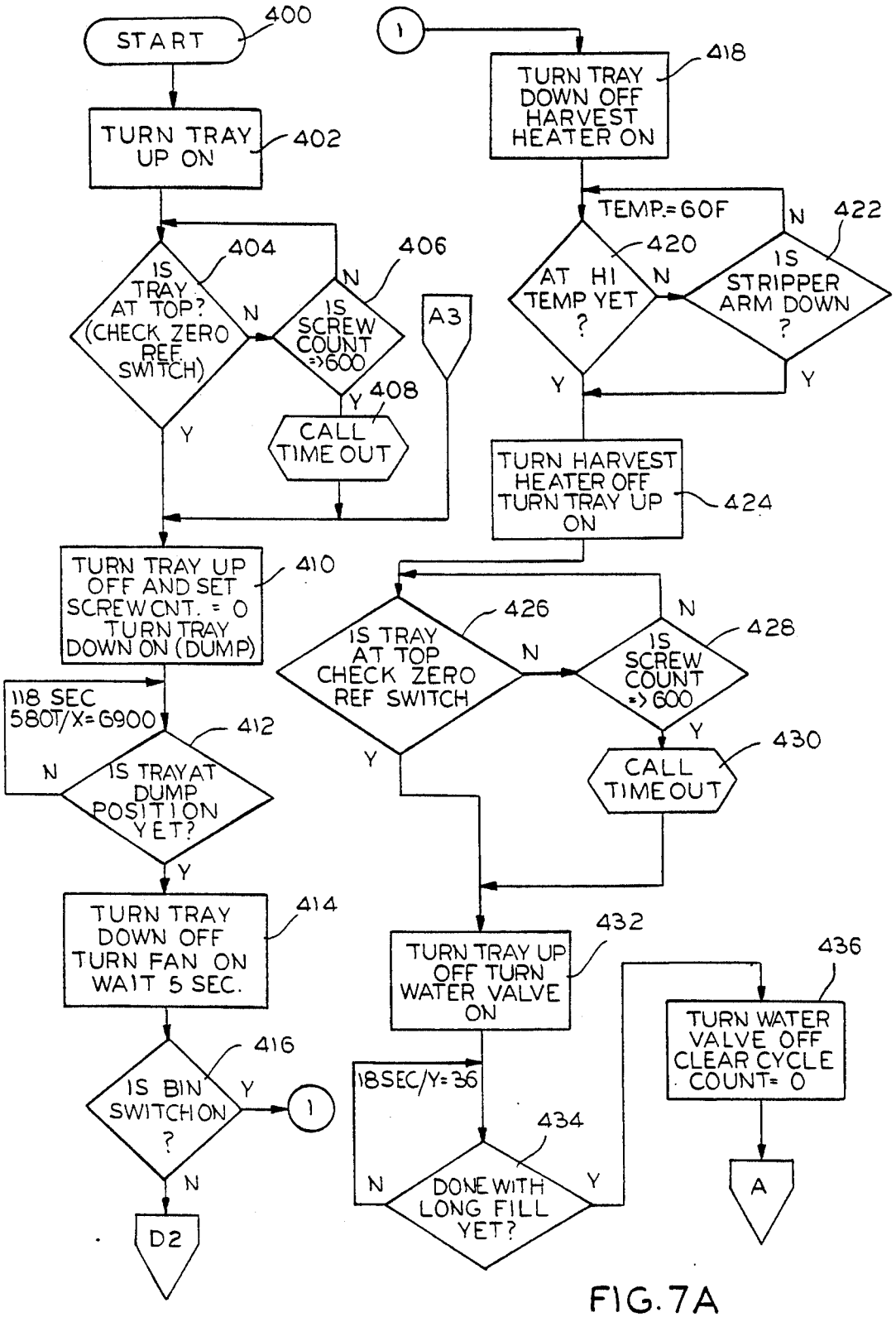
FIGS. 7A–7F comprise a series of flow diagrams illustrating operation of a program in the microcontroller of FIG. 5.
Figure 7B:
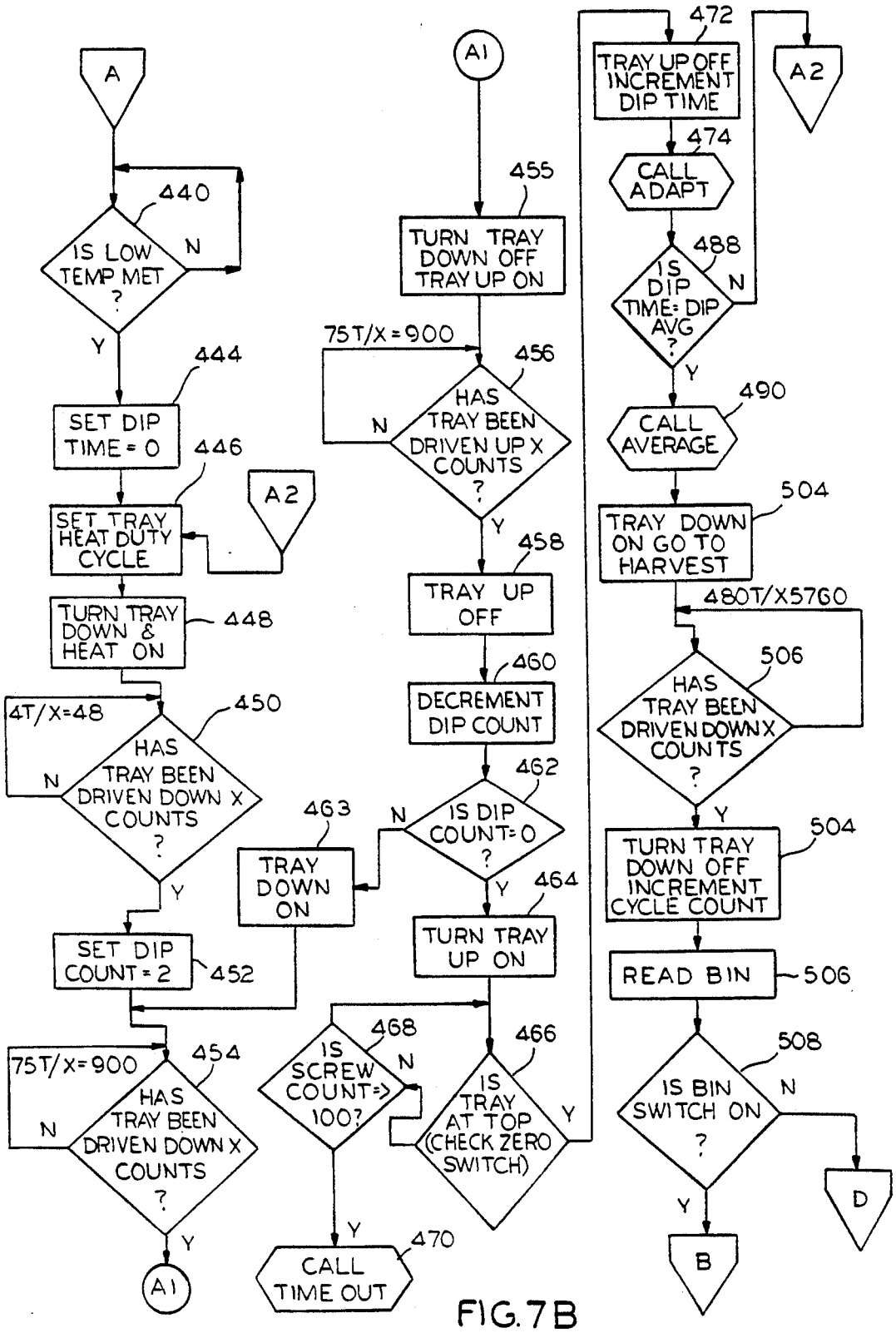

With reference initially to FIG. 7A, the program begins with a start node upon power up when a power up reset signal is received from the circuit 306. At a block 402 the program turns the tray up signal on by gating the triac S1 to energize the winding 338, see FIG. 6B. This drives the tray 162 continuously. A decision block 404 determines if the tray 162 is at the top position by checking the status of the zero switch circuit 308. If the tray 162 is not at the top, then a decision block 406 determines if a screw count value is greater than or equal to 600. Particularly, the two decision blocks 404 and 406 comprise a timing loop which counts the number of turns or revolutions of the motor 212 based on the number of 60 Hz pulses received from the zero crossing circuit 304. If the screw count is not greater than or equal to 600, then control loops back to the decision block 404. If the screw count equals or exceeds 600, then an error or jam condition is assumed to exist and a time out routine is called at a block 408.

Once the tray 162 is at the top, then at a block 410 the tray up output circuit 332 is turned off and the screw count value is set equal to zero. The tray down drive circuit 333 is then turned on to advance the tray 162 to the dump position. A decision block 412 loops on itself until the tray is at the dump position. The tray is determined to be at the dump position after 580 screw turns, represented by 6960 60 Hz pulses from the zero cross detector circuit 304. Once the tray 162 is at the dump position, see FIG. 15, the tray down drive circuit 333 is turned off at a block 414 and the fan drive circuit 336 is turned on and control waits for five seconds. A decision block 416 then determines if the bin switch is on as by checking the status of the bin switch circuit 312, see FIG. 6A. Particularly, if the bin switch is on, i.e., the bin arm 234 is in the down position, then additional ice is needed and control advances via a node 1 to a block 418. If not, then control advances via a node D2 to a park routine described below relative to FIG. 7E.

At the block 418, the tray down drive circuit 333 is maintained de-energized and the harvest heater drive circuit 335 is energized. Control then repeatedly interrogates a series of decision blocks 420 and 422 until either the sensed temperature is equal to 60° or the stripper arm 244 is in a down position, indicating that no ice bodies are present on the fingers 84. Once either of these conditions is satisfied, then the harvest heater drive circuit 335 is turned off at a block 424 and the tray up drive circuit 332 is turned on.

The tray up drive circuit 332 is maintained energized while a decision block 426 checks the status of the zero switch circuit 308 to sense when the tray 162 is at the top position, see FIG. 9. Concurrently, a decision block 428 determines if the screw count is greater than or equal to 600 and if so, then the time out routine is called at a block 430, as discussed above. Once the tray 162 is at the top position, the tray up drive circuit 332 is deenergized at a block 432 and the water drive circuit 334 is turned on to fill the tray 162 with a select volume of water. Particularly, at this point the tray 162 having come from a dump cycle is empty and therefore a long fill cycle is to be used. A decision block 434 determines if the long fill is done yet by providing an approximately eighteen second cycle determined by counting pulses from the zero cross detect circuit 34. Once the long fill is done, then at a block 436 the water valve drive circuit 334 is turned off and a value for cycle count is set equal to zero and control advances to a dip cycle shown in FIG. 7B.

The dip cycle begins at a decision block 440 which determines if a selected low temperature on the order of 28° F. is sensed by the thermistor 328. The control waits until this condition is satisfied, at which time control advances to a block 444 which sets a dip time equal to zero. During a dipping cycle the tray heater 178 is connected to the drive circuit 337 through spring switch blades 220, see FIG. 6B. However, the CPU 302 does not maintain energization of the drive circuit 337. Instead, the drive circuit 337 is pulse width modulated based on a select duty cycle. The duty cycle for operating the tray heater 178 is set at a block 446 based on an average desired duty cycle. At a block 448 the tray down drive circuit 333 is energized, as is the tray heater drive circuit 337. A decision block 450 determines if the tray 162 has been driven down four motor turns, i.e., 48 pulses from the zero cross detector circuit 304. This is done to ensure that the zero switch circuit 308 is no longer engaged. The dip count value is then set equal to two at a block 452. This is done to prevent too much use of the zero reference switch 230, as discussed below.

A decision block 454 waits until the tray down drive circuit 333 has been energized for nine hundred zero crosses, i.e. seventy-five motor turns. At the expiration of this wait time the tray down drive circuit 333 is deenergized at a block 455 and the tray up drive circuit 332 is energized to stop down movement of the tray and provide reciprocal up movement of the tray 162. During the dip cycle the tray 162 is alternately operated to move up and down for preselected motor cycle times to move the tray 162 up and down between the top dip position shown in FIG. 9 and a bottom dip position shown in FIG. 11. Particularly, the CPU 302 counts the number of pulses input from the zero cross detector circuit 304 and determines vertical movement of the tray 162. In an exemplary embodiment of the invention, the movement of the tray up and down is approximately three-fourths of an inch, which may represent seventy-five motor turns or nine hundred zero cross pulses received. In order to prevent jam-ups, the zero reference circuit 308 is used periodically to reset the programmable counters which count the zero cross input cycles.

The reciprocal movement of the tray 152 results in freezing the water about the fingers 82, as illustrated in FIG. 16, so that gases in the solution can escape. The dipping motion produced by reciprocal movement of the tray 162 relative to the fingers 82 provides a smooth ice body B with a crystal clear appearance. This reciprocating motion serves to polish the ice surface while it is freezing and mixes the bulk water it is freezing from to maintain uniform temperature in the bath. The bath is prevented from freezing by the tray heater 178 being periodically energized in accordance with the said duty cycle during the dipping operation.

Returning to the flow diagram, a decision block 456 determines if the tray up drive circuit 332 has been energized for seventy-five turns of motor operation. If so, then the tray up drive circuit 332 is turned off at a block 458 and the dip count is decremented at a block 460. A decision block 462 determines if the dip count is equal to zero. If not, then control advances to the block 463 to turn on the tray down drive circuit 333 and then to the block 454 to continue alternate down and up movement of the tray 162.

Once the dip count is equal to zero, as determined at the decision block 462, then it is necessary to return the tray 162 to the zero reference position. To do so, the tray up drive circuit 332 is turned on at a block 464. A decision block 466 then determines if the tray is at the top reference position by checking the status of the zero switch circuit 308. If not, then a decision block 468 determines if the screw count is equal to one hundred, representing a greater than desirable distance between the top dip position and the zero reference position If so, then the time out routine is called at a block 470. Otherwise, the control continues to loop as by returning to the decision block 466.

Once the tray is at the zero reference position, then the tray up drive circuit 332 is turned off at a block 472 and the dip time is incremented. In accordance with the invention, the motor 212 rotates approximately five revolutions per second. The up time, represented by seventy-five revolutions or turns, is fifteen seconds, as is the down time. Therefore, the cycle includes two up cycles and two down cycles prior to implementing the zero calibration. Thus, the dip time for such a period is approximately one minute so that the dip time is incremented by one minute at the block 472. An adapt routine is then called at a block 474.

Figure 23:
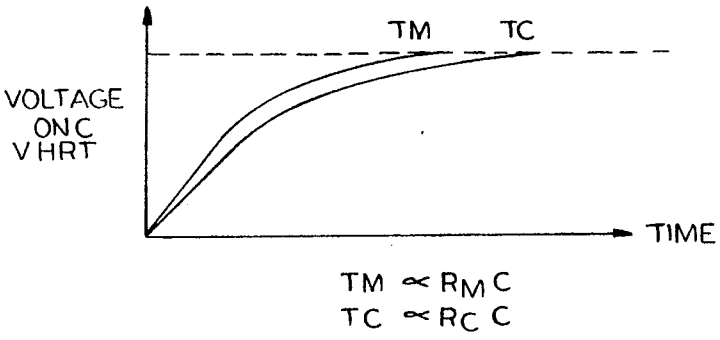
FIG. 23 is a graph illustrating a relationship between charge time and temperature for a temperature sensing routine used in the adaptive control scheme.
Figure 7C:
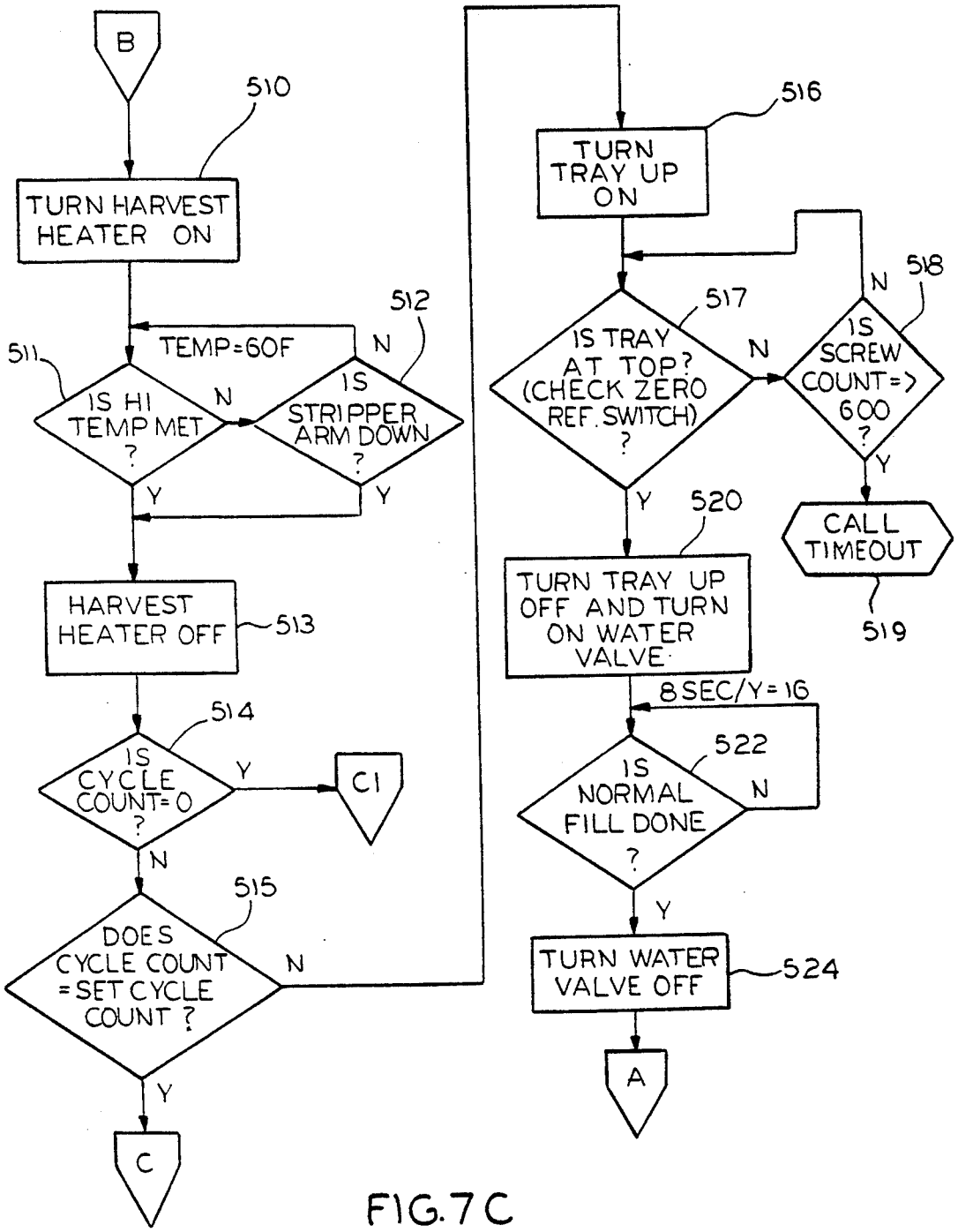
Figure 7D:
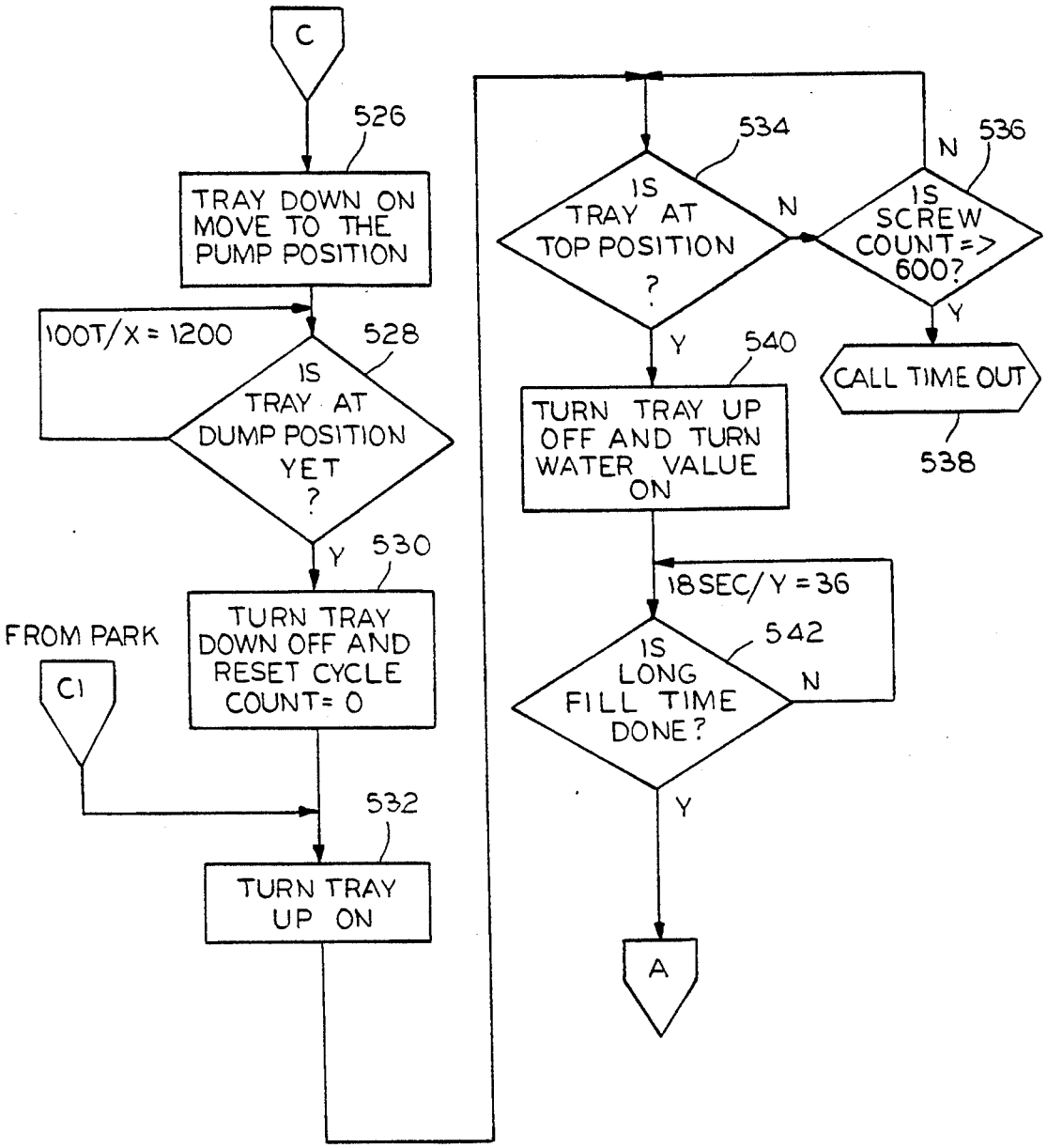
Figure 7E:
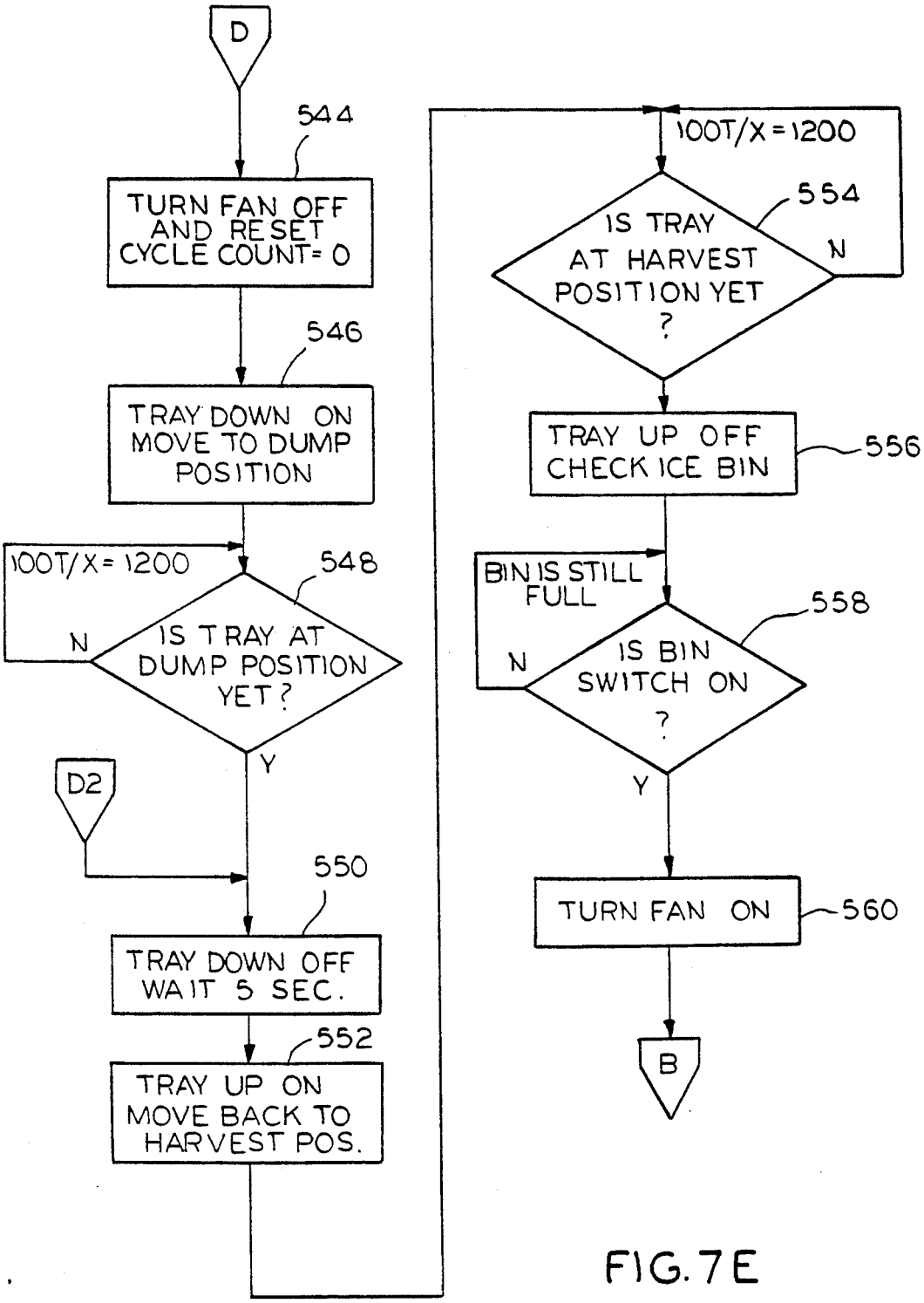
Figure 7F:
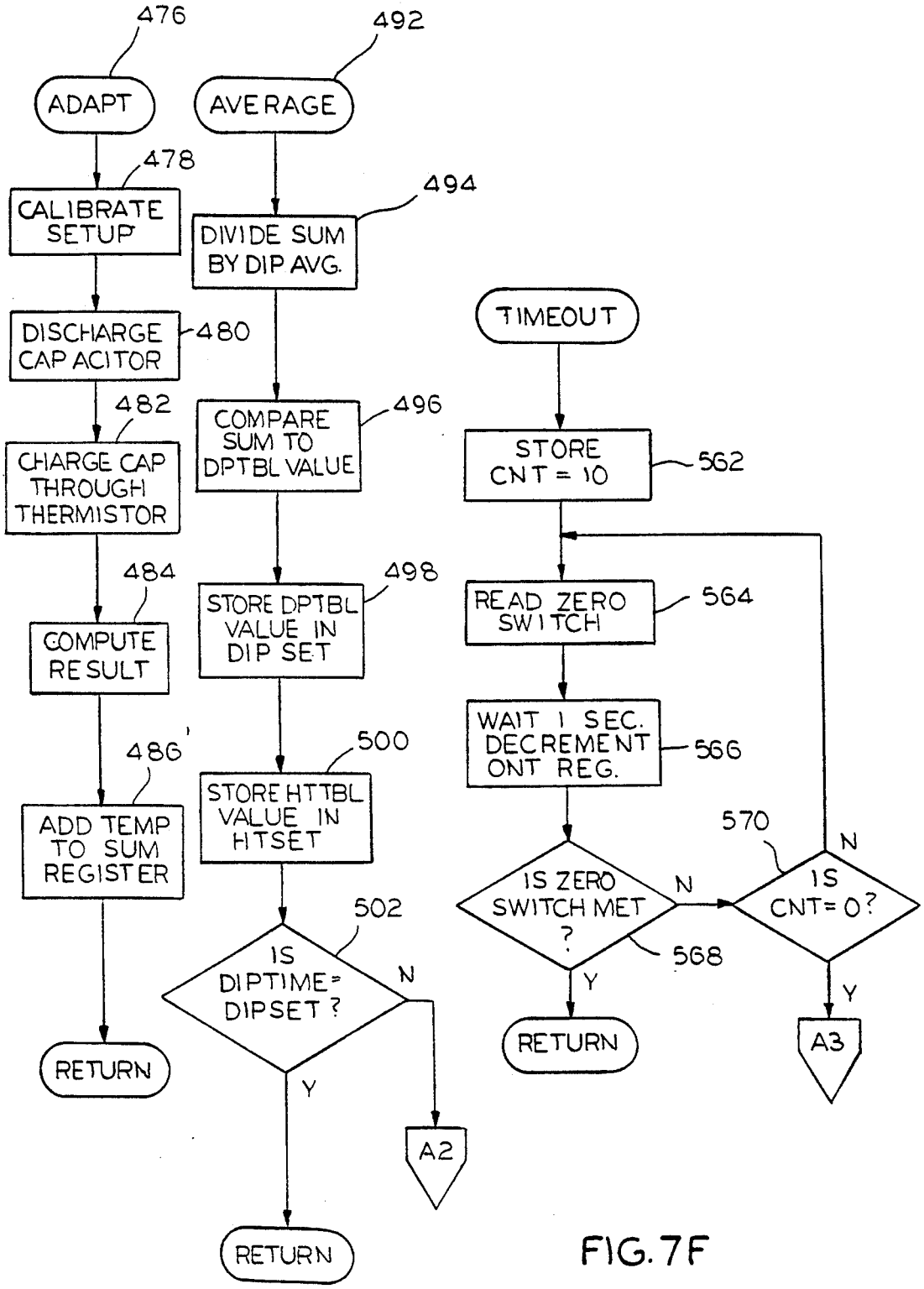

With reference to FIG. 7F, a flow diagram for the adapt routine is illustrated, beginning at a block 476. The adapt routine is used for calculating temperature of circulating air, i.e., temperature in the freezer compartment 16. To do so, a calibrate set up function is implemented at a block 478 as by charging the capacitor 330 of the temperature circuit 324 through the calibration resistor 326. Particularly, a reference voltage is applied to the calibration resistor 326 until a threshold is measured by the CPU 302 representing the charge in the capacitor 330. The CPU 302 determines the charge time. This generates a software calibration value used to calibrate out most circuit errors. The capacitor 330 is then discharged at a block 480. Then, at a block 482, the capacitor 330 is charged through the thermistor 328. The time to trip the preset threshold is measured and compared to the calibration value to determine the actual resistance of the thermistor 328. As is known, the resistance of the thermistor 328 changes with temperature. The actual temperature is represented by thermistor resistance which is determined using a charge time relationship as illustrated in FIG. 23. The resistance is computed at a block 484 by multiplying the measured charge time ($T_M$) of the thermistor 328 and capacitor 330 by the calibration resistance ($R_C$), and then dividing the result by the calibrated charge time ($T_C$) of the resistor 326 and the capacitor 330. The computed resistance value is added to a sum register at a block 486 and the adapt routine ends by returning to FIG. 7B.

Upon completion of the adapt routine, a decision block 488 determines if the dip time is equal to a dip average value labeled DIP AVG. This value represents a desired dip cycle time.

If the dip time is not equal to the dip average, then control advances via a node A to return to the block 446 to continue the dip cycle. If the dip time is equal to the dip average, then an average routine is called at a block 490. The average routine is illustrated in FIG. 7F beginning at a block 492. The average routine proceeds to a block 494 which divides the sum register value, determined at the block 486, by the dip average value. Particularly, this divides the running total of recorded temperature values by the amount of time allowed to take temperature samples.

Figure 19:
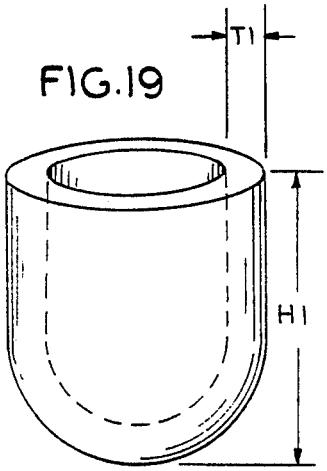
FIG. 19 is a perspective view illustrating a normal sized ice body formed with the ice maker of FIG. 3.
Figure 21:
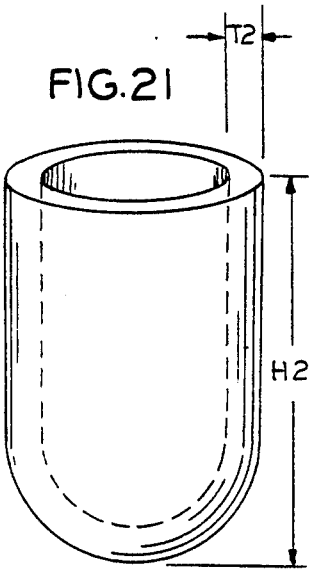
FIG. 21 is a perspective view illustrating a taller and thinner ice body as compared to that of FIG. 19.

The freezer compartment temperature determines the thickness of the ice bodies. For example, a normal size ice body resulting at a normal freezer compartment temperature is illustrated in FIG. 19. This ice body has a height H1 and thickness T1. If the available temperature is higher, then the initial thickness will be less and might be on the order of the thickness T2 illustrated in FIG. 21. However, the ice will not change as height is determined by level of water in tray 162. However, with a thinner ice body less water is used. When the fixed quantity of water is added to the tray 162 at the next fill, then the level of water in the tray 162 increases so that with each successive cycle, the height of the ice body will increase up to the level H2 illustrated in FIG. 21. This is a self-compensating feature which provides a uniform, average volume ice body over long periods of time.

Figure 20:
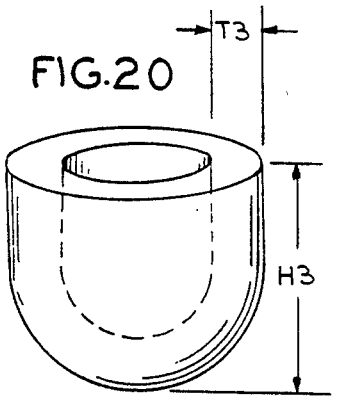
FIG. 20 is a partial perspective view illustrating a shorter and thicker ice body as compared to that of FIG. 19.

Conversely, under lower temperature conditions, a thicker ice body such as on the order of thickness T3 illustrated in FIG. 20 results. This results in more water being used and is added to each cycle so that eventually a shorter ice body having a height H3, such as illustrated in FIG. 20, results. This illustrates the self-compensating feature under colder freezer conditions.

In order to provide a more uniform size ice body under extreme temperature conditions, an adaptive control may also be utilized. Under normal freezer conditions, the size of the ice body is a function of dip time. However, since the size may vary depending on freezer air temperature extremes, as discussed above, the dip time can be varied in response to temperature.

Figure 22:
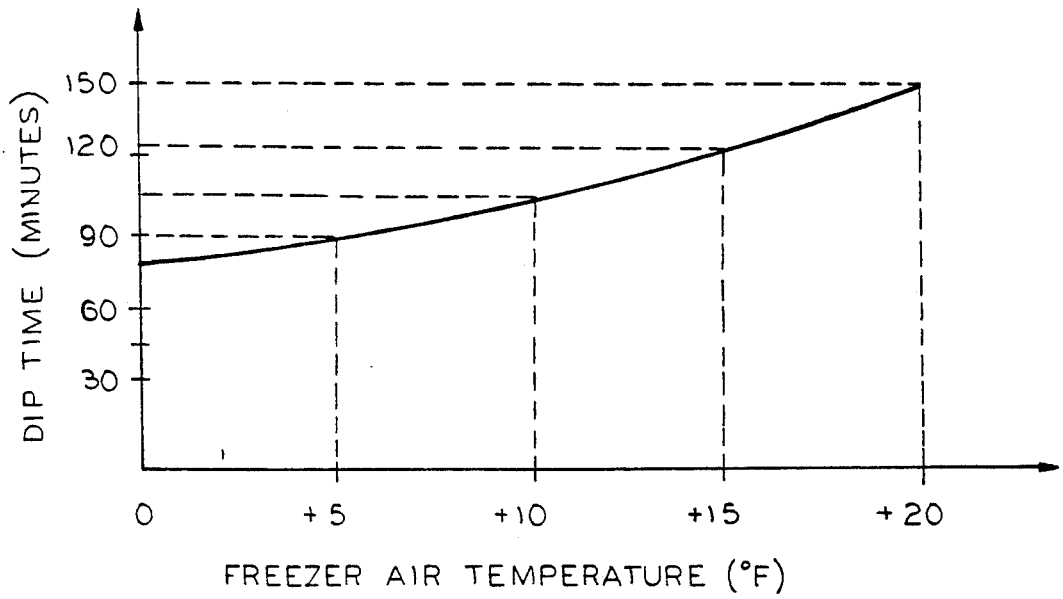
FIG. 22 is a curve illustrating data stored by the microprocessor for implementing an adaptive control scheme for providing uniform sized ice bodies.

With reference to FIG. 22, a non-linear curve illustrates the relationship between freezer air temperature and dip time to maintain a constant cube size in accordance with the invention. For example, with a freezer air temperature of 0° F., a dip time of approximately seventy minutes is used. If the freezer air is +10° F., then a dip time of one-hundred-ten minutes is used, while with a freezer air temperature of +5° F. a ninety minute dip time is used. This approach provides consistent ice body size independent of freezer temperature. To implement this feature, at a block 496 the quotient of the sum and DIP AVG values, representing average temperature, is compared to a look-up table labeled DPTBL, representing a table of dip times versus differential temperatures, to retrieve an adjusted dip time. The table DPTBL correlates to the curve of FIG. 22. The adjusted dip time value is stored in a DIPSET register at a block 498. A corresponding HTTBL table, representing tray heat duty cycle setting versus temperature, is accessed at a block 500 to retrieve a value stored in a HTSET register. Particularly, this register value determines duty cycle of the tray heater 178. As such, this routine is operable to decrease duty cycle of the tray heater 178 under higher freezer compartment temperature conditions to minimize energy consumption and improve ice clarity. A decision block 502 then determines if the dip time value is equal to dip set. In accordance with the invention, if the sensed temperature was higher than desirable, then the dip time would initially not yet be equal to the dip set value and control would return via the node A2 to the block 446, see FIG. 7B, to continue the dipping cycle. Once the dip time is equal to dip set, then the dip cycle is complete as by returning to the block 490, see FIG. 7B.

Figure 17:
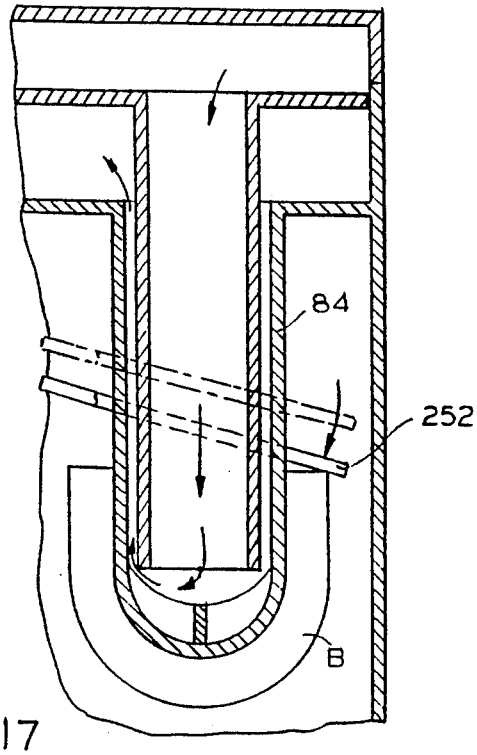
FIG. 17 is a view similar to that of FIG. 16 at the beginning of a harvest cycle.

Once the average routine is complete, then the tray down drive circuit 333 is energized at a block 504 to proceed to the harvest cycle. A decision block 506 waits until the tray 162 is driven down four hundred and eighty turns so that the tray 162 is in the harvest position shown in FIG. 13. The tray down drive circuit 333 is then turned off at a block 504 and a cycle count is incremented. As described above, when the tray 162 is in the harvest position, the bin arm 234, the cam actuator 264 releases the stripper 244 which is biased by the spring 252 downwardly. As a result, the stripper blades 2, which are inherently flexible, move downwardly so that they are on top of the ice bodies B as illustrated in FIG. 17 to individually provide downward vertical pressure on each of the ice bodies B. Also, as the cam 180 rotates to the park position, the arm 206 positions the damper 120 in the closed position as illustrated in FIG. 13.

Figure 10:
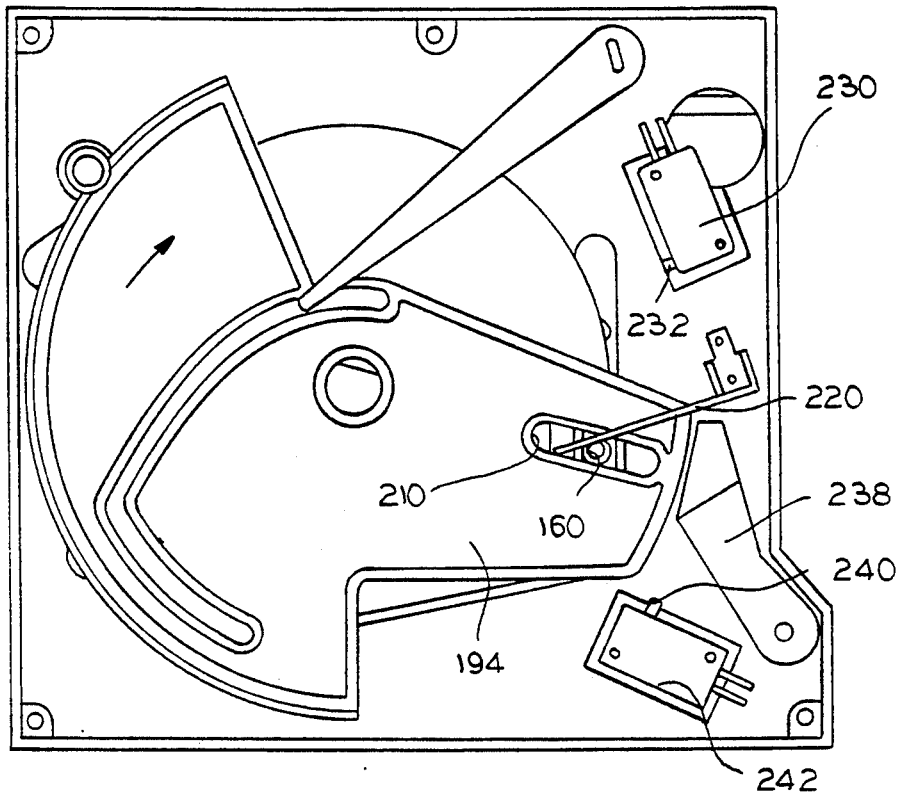
FIG. 10 is a view similar to that of FIG. 8 with the tray support in a bottom dip position.
Figure 11:
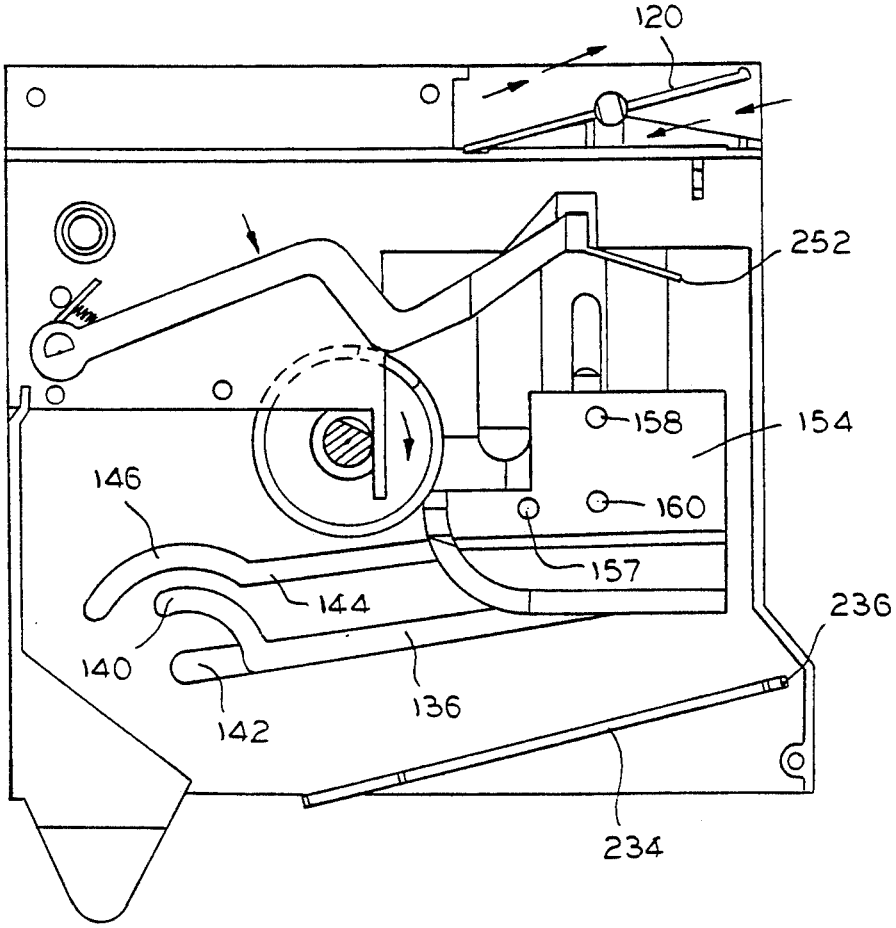
FIG. 11 is a view similar to that of FIG. 9 with the tray support in the bottom dip position.
Figure 12:
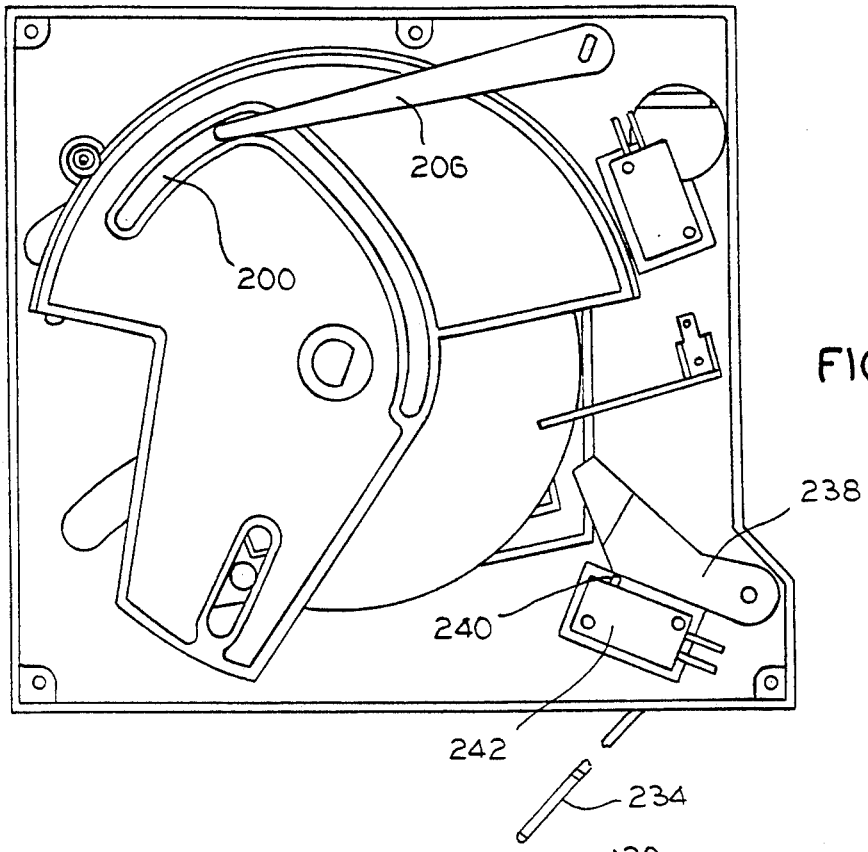
FIG. 12 is a view similar to that of FIG. 8 with the tray support in a harvest and park position.

When the tray carrier 134 moves from the bottom dip position of FIG. 11 to the harvest position of FIG. 13, the lever 238 is released, compare FIG. 10 to FIG. 12, to permit the bin arm 234 to drop. If sufficient ice has previously been harvested, it is not necessary to continue further operation. This is determined by the status of the bin arm 234. If the bin arm 234 falls sufficiently, then additional ice is needed. This is determined at a block 506 at which the status of the bin arm 234 reflected by the bin switch circuit 312 is read. If the bin switch is on, as determined at a decision block 508, then additional ice is needed and control advances via a node B to a harvest cycle, see FIG. 7C. If the bin switch is not on, indicating that the ice bin is full, then control advances via a node D to a park mode, see FIG. 7D.

With reference to FIG. 7C, the harvest cycle is illustrated. The harvest cycle begins at a block 510 at which the harvest heater drive circuit 335 is turned on to energize the harvest heater 128. Because the damper is in the closed position, see FIG. 13, the heated air is then circulated through the fingers 84 via the flow paths illustrated in FIG. 17. This heated air acts to slightly thaw the insides of the ice bodies B to release them from the fingers 84 in connection with the downward pressure of the stripper blades 252. Because the bottom of the ice maker 30 is open, refrigerated air in the freezer compartment 16 circulates in the area surrounding the fingers 84 and ice bodies B. This chilled air dries the outer surface of the ice bodies B as by freezing any water remaining on the same as the air is at a surface below 32° F.

The harvest cycle continues until the temperature sensed by the thermistor 328 reaches an elevated temperature on the order of 60° F. as determined at a decision block 511 or until the stripper arm 244 is down, indicating all ice bodies have been stripped, as determined by reading the status of the stripper arm switch 316 at a block 512. At the completion of the harvest cycle, the harvest heater drive circuit 335 is turned off at a block 513.

Periodically, it is desirable to dump remaining water in the tray 162. In accordance with the invention, this is done after the tray 162 has been in the park position to dump stale water, or after a select number of cycles. During the dipping cycle, only a portion of the water in the tray 162 is used to form the ice bodies B. At the beginning of the dip cycle, the tray is filled to replenish the water used. However, the solids concentration in the tray water will build up with each successive cycle as the purer water is frozen from solution. To ensure that clear ice is provided throughout operation, it is desirable to occasionally dump the residual water in the tray 162 to get rid of the solids, i.e., the minerals and impurities that have built up in the freezing bath.

At a decision block 514, a determination is made if the cycle count is equal to zero. This occurs when the harvest mode is implemented after the tray had been parked. If so, then control advances via a node C1 to a first dump mode illustrated in FIG. 7D. If the cycle count is not equal to zero, then a decision block 515 determines if the cycle count is equal to a set cycle count. The set cycle count is the desired number of cycles after which the tray 162 will be dumped. In an illustrated embodiment of the invention, the set cycle value may be set to seven. If the cycle count does equal the set cycle count, then the control advances via a node C to the dump cycle of FIG. 7D.

If the cycle count is not equal to the set cycle count, as determined at the decision block 515, then it is necessary to proceed with a fill and dip cycle. Initially, the tray up drive circuit 332 is energized at a block 516 and a decision block 517 waits until the tray is at the top or zero reference position. Concurrently, a decision block 518 determines of the screw count is greater than or equal to six hundred and if so calls the time out routine at a block 519. Otherwise, control returns to the decision block 517. Once the tray 162 is at the top, then the tray up drive circuit 332 is turned off at a block 520. Also, the water valve drive circuit 334 is turned on to begin a normal fill of the tray 162. The decision block 522 waits until the normal fill is done by waiting eight seconds as represented by sixteen half second increments as determined using the 60 Hz pulses from the zero cross detector circuit 304. Once the normal fill is done, then the water valve drive circuit 334 is turned off at a block 524 and control advances via a node A to the block 440 of FIG. 7B to begin a new dipping cycle.

With reference to FIG. 7D, the dump cycle is described beginning from the node C at a block 526. Initially, the tray down drive circuit 333 is energized to move the tray carrier 134 to the dump position shown in FIG. 15. A decision block 528 determines if the tray 126 is at the dump position based on a count value of one hundred corresponding to twelve hundred zero cross pulses. If so, then the tray down drive circuit 333 is turned off at a block 530 and the cycle count value is reset to zero. Thereafter, or if the dump cycle is initiated from the park mode via the node C1, then the tray up drive circuit 332 is turned on at a block 532 and a decision block 534 determines if the tray 162 is at the top position based on the status of the zero switch circuit 308, see FIG. 6A. A decision block 536 continually checks to determine if the screw count value is greater than or equal to six hundred, and if so calls the time out routine at a block 538. Once the tray 162 is at the top position, then the tray up drive circuit 332 is turned off at a block 540 and the water valve drive circuit 334 is turned on to begin the long fill. A decision block 542 waits for eighteen seconds, or thirty-six half second increments, for the long fill. At the completion of the long fill, the control returns via the node A to the decision block 440 of FIG. 7B to commence a dip cycle.

In accordance with the invention, prior to each dipping cycle water is added to dilute remaining water in the tray 162. The added water is equal to the volume of water removed in the harvested ice. The desire is to avoid the requirement of a drain being provided from the refrigerator. Instead, the water is only periodically sent to the evaporator drip pan. Since the dump cycle is only implemented periodically, the evaporator drip pan can handle this volume of water without concern of being overfilled.

With reference to FIG. 7E, the control for implementing the park mode is illustrated beginning at a block 544, which de-energizes the fan drive circuit 336 and resets the cycle count equal to zero. The tray down drive circuit 333 is turned on at a block 546 to move the tray 162 to the dump position to dump water from the tray 162 so that it does not freeze. Once the tray 162 is at the dump position, then the tray down drive circuit 333 is turned off at a block 550 and control waits five seconds to allow water to drain from the tray 162. The tray up drive circuit is then turned on at a block 552 to move the tray 162 to the harvest position of FIG. 13. A decision block 554 waits until the tray 162 is at the harvest position, again based on twelve hundred zero cross pulses being received. The tray up drive circuit 332 is then turned off at a block 556 and the bin switch circuit 312 is checked. A decision block 558 determines if the bin switch is on. If not, then control remains at the block 558 with the tray carrier 134 parked in the harvest position of FIG. 13 until such time as sufficient ice bodies are removed so that the bin arm 234 is dropped and the bin switch is turned on, at which time the fan drive circuit 336 is turned on at a block 560 and control advances via a node B to the harvest cycle of FIG. 7C to begin a harvest cycle.

With reference to FIG. 7F, the time out routine is illustrated. The time out routine begins at a block 562 which stores a count CNT value equal to ten. The zero switch circuit 308 is then read at a block 564. A one second wait is implemented at a block 566 and the count value is decremented by one. A decision block 568 then determines if the zero switch circuit 308 has been satisfied. If not, then a decision block 570 determines if the count value is equal to zero. If not, then control loops back to the block 564. This routine is operable to make ten attempts to read the zero switch circuit 308 with one second between tries. Once the count value is equal to zero, as determined at the block 570, then control advances via a node A3 to the block 410 of FIG. 7A to de-energize the tray up drive circuit 332 and proceed to the dump position, as discussed above. If the zero switch circuit 308 is satisfied, as determined at the decision block 568, then the time out routine ends and control proceeds as normal, dependent upon the point in the operating cycle at which the time out routine was called.

Thus, in accordance with the invention, a clear ice maker is provided which reciprocally moves a volume of water up and down relative to a refrigerated support to form ice bodies. The pure water in the volume freezes first, with solids in the solution settling to the bottom of a water tray. The water tray is eventually dumped and its concentration increases to maintain the crystal clearness of the formed ice bodies.

The illustrated embodiment of the invention is illustrative of the broad inventive concepts comprehended hereby.

We claim:

1. An ice maker for making clear ice bodies comprising:

a support arranged to have an ice body formed thereon;

means for refrigerating said support to a below freezing temperature;

a container adapted to hold a body of water;

means for moving the container to move liquid water contained therein uniformly about said support suitable to cause a clear substantially symmetrical ice body to build up outwardly on the refrigerated support, comprising a tray supporting said container, said tray including support pins received in a track defining a path of movement of said tray, and a drive controlling movement of said tray;

means for heating the container to prevent freezing of water contained therein; and means for causing harvesting of the ice body from the support.

2. The ice maker of claim 1 wherein said pins comprise conductive pins and said heating means comprises an electrical heater connected to said pins.

3. The ice maker of claim 2 further comprising electrical power terminals positioned at a select location of said tracks to control operation of said heating means incident to said tray being at a select position at the select location.

4. The ice maker of claim 1 wherein said heating means includes a control for operating said heating means only during a time period when said moving means moves the container to move liquid water about the support.

5. The ice maker of claim 1 further comprising storage means for causing repositioning of the container to withdraw the water in the container from adjacent the support prior to harvesting of the ice body.

6. The ice maker of claim 5 wherein said heating means includes a control for disabling said heating means during a time period when said storage means repositions the container to withdraw water from adjacent the support.

7. The ice maker of claim 1 wherein said heating means includes an electrical heater and a pulse width modulated control for energizing said electrical heater for a select duty cycle.

8. The ice maker of claim 7 further comprising means for sensing ice maker temperature and wherein said heating means includes means for varying said duty cycle of said pulse width modulated control in accordance with sensed temperature.

9. An ice maker for making clear ice bodies comprising:

a support arranged to have an ice body formed thereon, comprising a hollow plastic tubular member open at a near end and closed at a distal end;

refrigeration means for conducting refrigerated fluid through the open end of said tubular member to refrigerate said support to a below freezing temperature;

a container adapted to hold a body of water;

means for moving the container to move liquid water contained therein uniformly about said support suitable to cause a clear substantially symmetrical ice body to build up outwardly on the refrigerated support adjacent the closed end of said tubular member;

means for causing harvesting of the ice body from the tubular member comprising means for conducting heated fluid through the open end of said tubular member to heat said support to an above freezing temperature; and means for sensing temperature of said fluid and wherein said means for causing harvesting of the ice body further comprises means for terminating conduction of heated fluid through the open end of said tubular member responsive to temperature sensed by said sensing means being above a select temperature value.

10. The ice maker of claim 9 wherein said sensing means comprises a first charging circuit including a temperature sensitive resistance, a second charging circuit including a reference resistance and a control circuit for alternately operating said first and second charging circuits and comparing length of time required for each said charging circuit to reach a select charge level, a difference in such times representing ice maker temperature.

11. An ice maker for making clear ice bodies comprising:

a support arranged to have an ice body formed thereon;

means for refrigerating said support to a below freezing temperature;

a container adapted to hold a body of water;

cycle means for moving the container to move liquid water contained therein uniformly about said support suitable to cause a clear substantially symmetrical ice body to build up outwardly on the refrigerated support;

storage means for causing repositioning of the container to withdraw the water in the container from adjacent the support; and control means for controlling operation of said cycle means and said storage means and operable to operate said cycle means for a select time duration prior to operation of said storage means during a batch operation of said ice maker.

12. The ice maker of claim 11 wherein said control means includes means for sensing temperature of said ice maker and adaptive control means for varying said select time duration responsive to sensed temperature to provide uniform sized ice bodies in different batch operations of said ice maker.

13. The ice maker of claim 12 wherein said control means includes means operatively coupled to said sensing means for calculating average temperature during said select time duration and wherein said adaptive control means varies said select time duration responsive to average sensed temperature to provide uniform sized ice bodies in different batch operations of said ice maker.

14. The ice maker of claim 13 wherein said select time duration is increased responsive to average sensed temperature being above a select temperature to provide uniform sized ice bodies in different batch operations of said ice maker.

15. The ice maker of claim 11 wherein said control means includes means for sensing average temperature of said ice maker and adaptive control means for increasing said select time duration responsive to average sensed temperature being above a select value to provide uniform sized ice bodies in different batch operations of said ice maker.

16. An ice maker for making clear ice bodies comprising:

a support arranged to have an ice body formed thereon;

means for refrigerating said support to a below freezing temperature;

a container adapted to hold a body of water;

a motor controlled drive including an electrical motor operatively coupled to said container for moving the container;

a control circuit for controlling energization of said motor including means for determining duration of motor energization, first drive means for energizing said motor for a first select duration to raise said container, second drive means for energizing said motor for a second select duration to lower said container, and switching means for alternately operating said first and second drive means in successive dip cycles to reciprocally move the container to move liquid water contained therein uniformly about said support suitable to cause a clear substantially symmetrical ice body to build up outwardly on the refrigerated support.

17. The ice maker of claim 16 wherein said motor comprises a synchronous motor and said determining means determines a number of power cycles for which said motor has been energized.

18. The ice maker of claim 16 wherein said first select duration is equivalent to said second select duration.

19. The ice maker of claim 16 wherein said determining means comprises a counter means for storing a value representing said duration.

20. The ice maker of claim 19 further comprising means for counting number of dip cycles and reference means for operating one of said first and second drive means after a select number of dip cycles to move said container to a reference position and to thereafter reset said counter to a reference value.

21. The ice maker of claim 20 further comprising means connected to said control circuit for sensing if said container is in said reference position.

22. The ice maker of claim 21 wherein said sensing means comprises a limit switch.

23. The ice maker of claim 16 further comprising storage means for causing repositioning of the container to withdraw the water in the container from adjacent the support and said control circuit controls operation of said switching means and said storage means and is operable to operate said switching means for a select time duration prior to operation of said storage means during a batch operation of said ice maker.

24. The ice maker of claim 23 wherein said control circuit includes means for sensing temperature of said ice maker and adaptive control means for varying said select time duration responsive to sensed temperature to provide uniform sized ice bodies in different batch operations of said ice maker.

25. The ice maker of claim 16 further comprising means for causing harvesting of the ice body from the support comprising means for heating said support to an above freezing temperature.

26. An ice maker for making clear ice bodies comprising:

a support arranged to have an ice body formed thereon;

means for refrigerating said support to a below freezing temperature, a container adapted to hold a body of water;

means for moving the container to move liquid water contained therein uniformly about said support suitable to cause a clear substantially symmetrical ice body to build up outwardly on the refrigerated support;

storage means for causing repositioning of the container to withdraw the water in the container from adjacent the support; and means for causing harvesting of the ice body from the support, wherein said means for moving liquid water about said support includes means for utilizing a select volume of water in said container to form said ice body, said select volume being determined by level of water in said container and temperature of said support, and means for adding a fixed volume of water to said container subsequent to harvesting of the ice body from the support to provide a uniform, average volume ice body over a plurality of ice body making cycles.

27. The ice maker of claim 26 further comprising a control means for controlling operation of said moving means for a select time duration prior to operation of said storage means during a batch operation of said ice maker.

28. The ice maker of claim 27 wherein said control means includes means for sensing temperature of said ice maker and adaptive control means for varying said select time duration responsive to sensed temperature to provide uniform sized ice bodies in different batch operations of said ice maker.

29. The ice maker of claim 28 wherein said adaptive control means varies said select time generally proportionally to sensed temperature.

30. The ice maker of claim 28 wherein said sensing means comprises a first charging circuit including a temperature sensitive resistance, a second charging circuit including a reference resistance and a control circuit for alternately operating said first and second charging circuits and comparing length of time required for each said charging circuit to reach a select charge level, a difference in such times representing ice maker temperature.

31. An ice maker for making clear ice bodies comprising:

a support arranged to have an ice body formed thereon, comprising a hollow plastic tubular member closed at one end;

refrigeration means for conducting refrigerated fluid through said tubular member to refrigerate said support to a below freezing temperature;

a container adapted to hold a body of water;

means for moving the container to move liquid water contained therein uniformly about said support suitable to cause a clear substantially symmetrical ice body to build up outwardly on the refrigerated support adjacent the closed end of said tubular member;

means for causing harvesting of the ice body from the tubular member comprising means for conducting heated fluid through the open end of said tubular member to heat said support to an above freezing temperature;

means for sensing temperature of said fluid; and control means operatively coupled to said sensing means for controlling said moving means and said harvest means in accordance with sensed temperature, wherein said moving means is operated during a dip cycle until sensed temperature is below a first select temperature value and thereafter said harvesting means is operated for causing harvesting of the ice body during a harvest cycle until sensed temperature is above a second select temperature value.

32. The ice maker of claim 31 further comprising means for heating the container to prevent freezing of water contained therein said control means includes a pulse width modulated control for energizing said electrical heater for a select duty cycle.

33. The ice maker of claim 32 wherein said control means includes means for varying said duty cycle of said pulse width modulated control in accordance with sensed temperature.

34. The ice maker of claim 31 wherein said sensing means comprises a first charging circuit including a temperature sensitive resistance, a second charging circuit including a reference resistance and said control means alternately operates said first and second charging circuits and compares length of time required for each said charging circuit to reach a select charge level, a difference in such times representing ice maker temperature.

35. An ice maker for making clear ice bodies comprising:

a support arranged to have an ice body formed thereon;

means for refrigerating said support to a below freezing temperature;

a container adapted to hold a body of water;

water supply means connectable to a source of fresh water for controllably delivering fresh water from the source to said container;

means for moving the container to move liquid water contained therein uniformly about said support suitable to cause a clear substantially symmetrical ice body to build up outwardly on the refrigerated support, the ice body being of a volume less than available volume of the water so that residual water remains in the container;

means for periodically causing harvesting of the ice body from the support; and control means operatively associated with said water supply means for initially controlling said water supply means to deliver a first select volume of fresh water to substantially fill the container, and subsequent to each operation of the harvesting means controlling said water supply means to deliver a second select volume of fresh water, less than the first select volume of fresh water, so that subsequent bodies of water include both residual water and fresh water.

36. The ice maker of claim 35 further comprising means for dumping the residual water from the container after a preselected number of ice body making cycles has been completed and said control means controls said water supply means to deliver the first select volume of fresh water to substantially fill the container as an incident of the dumping means dumping the residual water.

37. The ice maker of claim 35 further comprising means for collecting the harvested ice bodies, and means for dumping the residual water from the container as an incident of the collecting means having a select full level of ice bodies therein and said control means controls said water supply means to deliver the first select volume of fresh water to substantially fill the container as an incident of the dumping means dumping the residual water.

38. An ice maker for making clear ice bodies comprising:

a support arranged to have an ice body formed thereon;

means for refrigerating said support to a below freezing temperature;

a container adapted to hold a body of water;

water supply means connectable to a source of fresh water for controllably delivering fresh water from the source to said container;

means for moving the container to move liquid water contained therein uniformly about said support suitable to cause a clear substantially symmetrical ice body to build up outwardly on the refrigerated support, the ice body being of a volume less than available volume of the water so that residual water remains in the container;

means for periodically causing harvesting of the ice body from the support;

means for dumping the residual water from the container after a preselect number of ice body making cycles has been completed; and control means operatively associated with said water supply means for initially and incident to the dumping means dumping residual water controlling said water supply means to deliver a first select volume of fresh water to substantially fill the container, and subsequent to each operation of the harvesting means controlling said water supply means to deliver a second select volume of fresh water, less than the first select volume of fresh water, so that subsequent bodies of water include both residual water and fresh water.

39. The ice maker of claim 38 further comprising means for collecting the harvested ice bodies, and said dumping means also dumps the residual water from the container as an incident of the collecting means having a select full level of ice bodies therein.

40. An ice maker for making clear ice bodies comprising:

a support arranged to have an ice body formed thereon;

means for refrigerating said support to a below freezing temperature;

a container adapted to hold a body of water;

water supply means connectable to a source of fresh water for controllably delivering fresh water from the source to said container;

means for moving the container to move liquid water contained therein uniformly about said support suitable to cause a clear substantially symmetrical ice body to build up outwardly on the refrigerated support, the ice body being of a select volume less than available volume of the water so that residual water remains in the container;

means for periodically causing harvesting of the ice body from the support; and control means operatively associated with said water supply means for initially controlling said water supply means to deliver a first select volume of fresh water to substantially fill the container, and subsequent to each operation of the harvesting means controlling said water supply means to deliver a second select volume of fresh water, less than the first select volume of fresh water and substantially equal to the select volume of the ice body, so that subsequent bodies of water include both residual water and fresh water having a volume substantially equal to the first select volume.

41. The ice maker of claim 40 further comprising means for dumping the residual water from the container after mineral content in the residual water becomes too concentrated and said control means controls said water supply means to deliver the first select volume of fresh water to substantially fill the container as an incident of the dumping means dumping the residual water.

42. The ice maker of claim 41 further comprising means dumps the residual water from the container after a preselected number of ice body making cycles has been completed

43. An ice maker for making clear ice bodies comprising:

a support arranged to have an ice body formed thereon;

means for refrigerating said support to a below freezing temperature;

a container adapted to hold a body of water;

water supply means connectable to a source of fresh water for controllably delivering fresh water from the source to said container;

means for moving the container to move liquid water contained therein uniformly about said support suitable to cause a clear substantially symmetrical ice body to build up outwardly on the refrigerated support, the ice body being of a select volume less than available volume of the water so that residual water remains in the container;

means for causing repositioning of the container to withdraw water in the container from adjacent the support and including means for dumping water from the container to be disposed of by evaporation;

means for periodically causing harvesting of the ice body from the support; and control means operatively associated with said water supply means for initially controlling said water supply means to deliver a first select volume of fresh water to substantially fill the container, and subsequent to each operation of the harvesting means controlling said water supply means to deliver a second select volume of fresh water, less than the first select volume of fresh water, so that subsequent bodies of water include both residual water and fresh water, and for controlling the dumping means to dump the residual water from the container after a preselected number of ice body making cycles has been completed and then control said water supply means to deliver the first select volume of fresh water to substantially fill the container as an incident of the dumping means dumping the residual water, to limit the amount of liquid water removed to that which can be removed by evaporation.

* * * * *